US006337169B1

(12) United States Patent
Hashimoto et al.

(10) Patent No.: US 6,337,169 B1
(45) Date of Patent: Jan. 8, 2002

(54) TONER AND IMAGE FORMING METHOD USING THE TONER

(75) Inventors: Akira Hashimoto, Numazu; Satoshi Yoshida, Tokyo; Manabu Ohno; Yasukazu Ayaki, both of Numazu; Satoshi Handa, Shizuoka-ken; Keiji Komoto, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/606,172

(22) Filed: Jun. 29, 2000

Related U.S. Application Data

(62) Division of application No. 09/221,140, filed on Dec. 28, 1998, now Pat. No. 6,177,223.

(30) Foreign Application Priority Data

Dec. 27, 1997 (JP) ..... 9-368006
Dec. 22, 1998 (JP) ..... 10-363682

(51) Int. Cl.[7] ..... G03G 13/16; G03G 9/08

(52) U.S. Cl. ..... 430/126; 430/110.1; 430/110.3; 430/111.4; 430/124; 430/125; 430/108.8

(58) Field of Search ..... 430/106, 109, 430/110, 111, 120, 124, 125, 126, 108.8, 108.9, 110.1, 110.2, 110.3, 111.4

(56) References Cited

U.S. PATENT DOCUMENTS 4,740,443 A * 4/1988 Nakahara et al. ..... 430/110
5,283,149 A * 2/1994 Tyagi et al. ..... 430/106
5,413,890 A 5/1995 Mori et al. ..... 430/110
5,698,354 A * 12/1997 Ugai et al. ..... 430/111
5,753,396 A 5/1998 Nakamura et al. ..... 430/111

FOREIGN PATENT DOCUMENTS

EP 0595642 5/1994
EP 0658816 6/1995
EP 0743563 11/1996

OTHER PUBLICATIONS

Patent Abstracts of Japan., 10, 264 (R495) 9/86 for JP61–088271.
Patent Abstracts of Japan., 14, 011, (P–988) 1/90 for JP01–259369.
Database WPI, Sec.Ch,Wk.8737, Derwent Publ., AN87–260561; XP002099658 of JP 62180374A.
Database WPI, Sec.Ch, WK.8537, Derwent Publ., AN85–226964, XP002099659 of JP 60147748A.

* cited by examiner

*Primary Examiner*—Janis L. Dote
(74) *Attorney, Agent, or Firm*—Fitzpatrick, Cella, Harper & Scinto

(57) ABSTRACT

A toner suitable for use in electrophotography, etc., is composed of toner particles each containing a binder resin, a colorant and a wax component. Each toner particle has such a microtexture as to provide a cross section as observed through a transmission electron microscope (TEM) exhibiting a matrix of the binder resin, a particle of the wax enclosed with the matrix; and the binder resin dispersed in a particulate form in the wax particle, and the toner particles have a residual monomer content of at most 500 ppm by weight of the toner particles. The colorant may also be dispersed in the wax particle enclosed within the matrix of the binder resin.

45 Claims, 6 Drawing Sheets

TONER AND IMAGE FORMING METHOD USING THE TONER

This is a division of Application No. 09/221,140, filed Dec. 28, 1998, which is now U.S. Pat. No. 6,177,223 B1.

FIELD OF THE INVENTION AND RELATED ART

The present invention relates to a toner for use in a recording method or image forming method, such as electrophotography, electrostatic recording, magnetic recording or toner jetting, and an image forming method using the toner. More specifically, the present invention relates to a toner for use in an image recording apparatus applicable to a copying machine, a printer, a facsimile apparatus, a plotter, etc., and an image forming method using the toner.

Hitherto, a large number of electrophotographic processes have been known, inclusive of those disclosed in U.S. Pat. Nos. 2,297,691; 3,666,363; and 4,071,361. In these processes, in general, an electrostatic latent image is formed on a photosensitive member comprising a photoconductive material by various means, then the latent image is developed with a toner, and the resultant toner image is transferred via or without via an intermediate transfer member onto a transfer(-receiving) material such as paper etc., as desired, fixed by heating, pressing, or heating and pressing, or with solvent vapor to obtain a copy or print carrying a fixed toner image. A portion of the toner remaining on the photosensitive member without being transferred is cleaned by various means, and the above mentioned steps are repeated for a subsequent cycle of image formation.

An example of ordinary full-color image forming process will now be described. A photosensitive member (electrostatic image-bearing member) in the form of a drum is uniformly charged by a primary charger and then subjected to imagewise exposure with laser light modulated by a magenta image signal obtained from an original to form an electrostatic image on the photosensitive drum, which is then developed with a magenta toner contained in a magenta developing device to form a magenta toner image. Then, the magenta toner image formed on the photosensitive drum is transferred directly or indirectly onto a transfer material under the action of a transfer charger.

The photosensitive drum after the above-mentioned developing of an electrostatic image is charge-removed by a charge-removing charger and cleaned by a cleaning means so as to be prepared for a subsequent cyan-image forming cycle including charging again by the primary charger, a cyan toner image formation and a transfer of the cyan toner image onto the transfer material carrying the magenta toner image already transferred thereto, followed further by a yellow-image forming cycle and a black image forming cycle to provide the transfer material with four-color toner images thereon. Then, the transfer material carrying the four-color toner images is subjected to fixation under application of heat and pressure, thereby forming a full-color image.

In recent years, an image-forming apparatus performing an image forming method as described above not only is used as a business copier for simply reproducing an original but also has been used as a printer, typically a laser beam printer (LBP), for computer output, and a personal copier (PC) for individual users.

In addition to such uses as representatively satisfied by a laser beam printer, the application of the basic image forming mechanism to a plain paper facsimile apparatus is also popular.

For such uses, the image forming apparatus has been required to be smaller in size and weight and satisfy higher speed, higher quality and higher reliability. Accordingly, the apparatus has been composed of simpler elements in various respects. As a result, the toner used therefor is required to show higher performances. Further, in accordance with various needs for copying and printing, a greater demand is urged for color image formation, and a higher image quality and a higher resolution are required for faithfully reproducing an original color image. There is also an increasing demand for an image forming system allowing the formation of an image sheet having images on both sides from an original sheet having images on both sides.

In order to comply with the demands for a toner used in such a color image forming process, each color toner is required to exhibit excellent meltability and color-mixing characteristic on heating under application of a pressure. For this purpose, it is preferred to use a toner having a low softening point and a melt-viscosity which sharply decreases down to a low value below a prescribed temperature (i.e., having a high degree of sharp melting characteristic). By using such a toner, it is possible to provide a color copy satisfying a broader range of color reproducibility and faithful to the original image.

However, such a color toner having a high degree of sharp meltability generally has a high affinity to a fixing roller and is liable to cause offsetting onto the fixing roller at the time of fixation.

Particularly, in the case of a fixing device for a color image forming apparatus, a plurality of toner layers including those of magenta toner, cyan toner, yellow toner and black toner, are formed on a transfer-receiving material, so that the offset is liable to be caused as a result of an increased toner layer thickness.

Hitherto, in order to prevent the attachment of a toner onto a fixing roller surface, it has been practiced to compose the roller surface of a material, such as a silicone rubber or a fluorine-containing resin, showing excellent releasability against a toner, and coat the roller surface with a film of a liquid showing a high releasability, such as silicone oil or a fluorine-containing oil, for the purpose of preventing offset and deterioration of the roller surface. However, such a measure, though very effective for preventing toner offset, requires an equipment for supplying the offset-preventing liquid and complicates the fixing device. Further, the oil application is liable to promote a peeling between layers constituting the fixing roller, thus causing a shorter life of the fixing roller.

Accordingly, based on a concept of not using such a silicone oil-supplying device but supplying an offset-preventing liquid from toner particles on heating under pressure, it has been proposed to incorporate a release agent, such as low-molecular weight polyethylene or low-molecular weight polypropylene within toner particles.

For example, the incorporation of a wax in toner particles has been disclosed in Japanese Patent Publication (JP-B) 52-3304, JP-B 52-3305 and Japanese Laid-Open Patent Application (JP-A) 57-52574.

Further, the incorporation of a wax in toner particles is also disclosed in JP-A 3-50559, JP-A 2-79860, JP-A 1-109359, JP-A 62-14166, JP-A 61-273554, JP-A 61-94062, JP-A 61-138259, JP-A 60-252361, JP-A 60-252360 and JP-A 60-217366.

Wax has been used in order to provide improved anti-offset characteristic of the toner at low or high temperatures, and also an improved fixability at low temperatures. On the other hand, the resultant toner is liable to have a lower anti-blocking property or inferior developing performance due to migration of the wax to the surface of toner particles when exposed to heat due to a temperature increase in a copying machine or due to a long term of standing of the toner.

For such problems, a great expectation has been imparted to development of a novel toner.

For complying with such an expectation, a toner obtained through a suspension polymerization process has been proposed (JP-B 36-10231). In the suspension polymerization process, a monomer composition is prepared by uniformly mixing (i.e., dissolving or dispersing) a polymerizable monomer and a colorant, and optionally a polymerization initiator, a crosslinking agent, a charge control agent, and other additives, and the monomer composition is dispersed in an aqueous medium containing a dispersion stabilizer under the action of an appropriate stirrer, and subjected to polymerization, thereby providing toner particles having a desired particle size.

In the suspension polymerization process, the monomer composition is dispersed into liquid droplets in a dispersion medium, such as water, having a large polarity. Accordingly, a component having a polar group contained in the monomer composition is concentrated at the surface of the droplets, i.e., the boundary with the aqueous phase, and non-polar components are predominantly present at the inner part, thus providing a so-called core/shell structure. Thus, by enclosing a wax component as a release agent, a polymerization process toner can satisfy, in combination, low-temperature fixability, and anti-blocking property, durability and anti-high-temperature offset property, which are generally contradictory with each other. Further, it is also possible to prevent high-temperature offset without applying a release agent, such as oil, onto the fixing roller.

JP-A 6-194877 has disclosed toner particles having a so-called sea-island-sea texture wherein a crystalline (meth) acrylate polymer is dispersed in a matrix of binder resin as a plurality of domains each in turn containing a plurality of domains of the binder resin. By using behenyl (meth) acrylate having a relatively high melt-viscosity as an anti-high-temperature offset agent, it is possible to obtain a toner having excellent anti-high temperature offset property. However, as the crystalline behenyl (meth)acrylate has an excessively high melt-viscosity, the resultant toner is liable to show inferior low-temperature-fixability, thus requiring a further improvement in this respect. Further, as the anti-high-temperature offset agent is crystalline, it provides a fixed toner image exhibiting poor optical transmittance when formed on an OHP film, so that the application thereof to a full color toner is difficult.

Further, even in a toner having such a sea-island-sea texture, the texture is liable to collapse when the toner contains much residual monomer or is left standing for a long term to have the resin in the wax become missible with the wax, whereby the effect attributable to the sea-island-sea texture cannot be sufficiently achieved to cause a lowering in mechanical strength of the toner particles.

Incidentally, each toner particle contains a colorant of various pigment or dye as an indispensable component, and many of such colorants are somewhat hygroscopic, thus being liable to result in a problem regarding environmental stability. As an improvement to the problem, JP-A 63-19663 has disclosed a spherical toner with a suppressed amount of carbon black exposed to toner particle surfaces; and JP-A 5-289396 has disclosed full-color toner particles each containing one of yellow, magenta and cyan colorants while suppressing the exposure of the colorants to the toner particle surfaces, by finely dispersing resin domains containing such colorants dispersed therein in a thermoplastic matrix resin in the presence of a dispersion aid. According to the teaching of these references, it is possible to obtain a toner exhibiting stable chargeability regardless of environmental humidity by suppressing the exposure of colorant to toner particle surfaces. However, the toner of JP-A 63-19663 is liable to provide images insufficient in blackness, and the toner of JP-A 5-289396 is liable to have insufficient low-temperature fixability.

On the other hand, JP-A 4-73662 has disclosed toner particles having an outer shell of insulating resin layer formed by a mechano-chemical reaction and containing a high dielectric electroconductivity-imparting substance, such as carbon black, enclosed within the insulating resin layer. However, the toner of this reference has left room for improvement regarding blackness and gloss.

Hitherto, in full color copying machines, there has been frequently included a full-color image forming system wherein four photosensitive members and a transfer belt are included, and cyan, magenta, yellow and black toner images formed on the respective photosensitive member by developing electrostatic latent images thereon with respective color toners are successively transferred onto a recording sheet carried on the transfer belt and conveyed to positions disposed between the respective photosensitive members and the transfer belt along a straight pass, thereby forming a full-color image; or a system wherein a recording sheet is wound by an electrostatic force or a mechanical action as by a gripper about the surface of a transfer drum disposed opposite to a photosensitive member and developing and transfer steps are repeated in four cycles, to form a full color image.

Further, in recent years, as copying or recording sheets for full-color recording, there has been an increasing demand to use a variety of materials inclusive of a thick paper or card, and a small-size paper such as a post card, in addition to conventionally used plain paper or overhead projector (OHP) films. In the above-mentioned system using four photosensitive members, the recording sheet is transferred along a straight pass, so that the system is applicable to a broad range of recording sheet materials. In the system, however, plural toner images required to be superposed in registration with each other on the recording sheet at prescribed positions and even a slight deviation in registration leads to a failure in production in high-quality images at a good reproducibility, thus requiring a complicated conveying mechanism, resulting in a lowering in reliability and an increase in number of parts. On the other hand, in the system wherein the recording sheet attached onto and wound about the transfer member, a thick paper having a large basis weight when used as the recording sheet is liable to cause a failure in attachment at a trailing end thereof due to its stiffness thus being liable to results in image defects due to transfer failure. Such image defects are liable to occur also on small-size papers.

A full-color imaging apparatus using a drum-shaped intermediate transfer member is also known as disclosed in U.S. Pat. No. 5,187,526 and JP-A 4-16426. The U.S. Patent describes that high-quality images can be formed by using an intermediate transfer roller having a polyurethane-based surface layer having a volumetric resistivity of below $10^9$ ohm.cm in combination with a transfer roller with a similar surface layer but having a volume resistivity of at least $10^{10}$ ohm.cm. However, in order to supply a sufficient transfer charge to a toner image to be transferred in such a system, a high output electric field is required so that the surface layer composed of polyurethane with an electroconductivity-imparting material dispersed therein is liable to cause local breakdown, where noticeable image disorder is generated when forming a halftone image of a small toner coverage. Moreover, such a high-voltage application is liable to result in a transfer failure due to transfer current leakage caused by a lowering in resistivity of recording sheet when used in a high-humidity environment of a relative humidity exceeding 60% RH and can also result in a transfer failure due to a non-uniform resistivity of the recording sheet even in a low-humidity environment of a relative humidity below 40% RH in some cases.

JP-A 59-15739 and JP-A 59-5046 disclose a relation between a system using an intermediate transfer member and a toner used therein. However, these references merely disclose an effective transfer of a toner of 10 $\mu$m or smaller by using an adhesive intermediate transfer member, and a toner image is once transferred from a photosensitive member to the intermediate transfer member and then transferred from the intermediate transfer member to a recording sheet, so that the transfer efficiency has to be increased compared with the above-mentioned conventional systems. Particularly, in the case of a full-color copying machine compared with a monochromatic copying machine using a single black toner, the amount of toners held on the photosensitive member is increased, so that it is difficult to increase the transfer efficiency simply by using a conventional toner. Further, in the case of using a conventional toner, due to a shearing force or rubbing force acting between the photosensitive member or the intermediate transfer member and a cleaning member, and/or between the photosensitive member and the intermediate transfer member, the melt-sticking or filming of the toner onto the surface of the photosensitive member or the intermediate transfer member is liable to occur to cause a lowering in transfer efficiency and/or a failure in uniform transfer of four-color toner images in full-color image formation leading color irregularity or a problem in color balance, so that it is difficult to stably output high-image quality full-color images.

Further, respective color toners charged in an ordinary full-color copying machine are required to cause sufficient color mixing with each other in the fixing step to provide good color reproducibility and good transparency for OHP images, so that such color toners may generally preferably comprise a sharp-melting resin of a lower molecular weight than a black toner. An ordinary black toner contains a release agent having a relatively high crystallinity, as represented by polyethylene wax or polypropylene wax, in order to provide a good anti-high-temperature offset property at the time of fixation. In the case of full-color toners, however, such a crystalline release agent results in an OHP toner image having a remarkably lower transparency. For this reason, such a release agent is not added as an ordinary color toner component, but silicone oil, etc., is applied onto a heat-fixing roller to improve the anti-high-temperature offset property. However, a record sheet carrying the thus-fixed toner image retains excessive silicone oil, etc., attached thereto, so that a user can feel unpleasant in use thereof. As described above, a full-color image forming system using an intermediate transfer member and having many transfer positions has left problems to be solved at present. The above-mentioned references JP-A 59-15739 and JP-A 59-5046 have not proposed solutions to these problems regarding the toner and intermediate transfer member.

SUMMARY OF THE INVENTION

An object of the present invention is to provide a toner having good low-temperature fixability and storage stability and also good continuous image forming characteristics, and an image forming method using such a toner.

Another object of the present invention is to provide a toner capable of providing with good hue and proper gloss, and an image forming method using such a toner.

According to the present invention, there is provided a toner, comprising: toner particles each containing a binder resin, a colorant and a wax; wherein each toner particle has such a microtexture as to provide a cross section as observed through a transmission electron microscope (TEM) exhibiting a matrix of the binder resin, a particle of the wax enclosed with the matrix, and a resin dispersed in a particulate form in the wax particle, and the toner particles have a residual monomer content of at most 500 ppm by weight of the toner particles.

According to another aspect of the present invention, there is also provided a toner, comprising: toner particles each containing a binder resin, a colorant and a wax; wherein each toner particle has such a microtexture as to provide a cross section exhibiting a matrix of the binder resin, and a particle of the wax enclosed within the matrix, and the colorant is dispersed to provide a projection area (B) in the binder resin and a projection area (W) in the wax giving a ratio B/W of 0/100–80/20, respectively as observed through a transmission microscope (TEM).

According to still another aspect of the present invention, there is provided an image forming method, comprising:

a charging step of charging an image-bearing member, an electrostatic image forming step of forming an electrostatic image on the charged image-bearing member;

a developing step of developing the electrostatic image with either one of the above-mentioned toners carried on a developer-carrying member to form a toner image on the image bearing member, a transfer step of transferring the toner image on the image-bearing member to an intermediate transfer member onto a recording material, and a fixing step of heat-fixing the toner image on the recording material.

According to a further aspect of the present invention, there is provided an image forming method, comprising:

a charging step of charging an image-bearing member, an electrostatic image forming step of forming an electrostatic image on the charged image-bearing member;

a developing step of developing the electrostatic image with either one of the above-mentioned toners carried on a developer-carrying member to form a toner image on the image bearing member, a first transfer step of transferring the toner image on the image-bearing member to an intermediate transfer member, a second transfer step of transferring the toner image on the intermediate transfer member onto a recording material, and a fixing step of heat-fixing the toner image on the recording material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
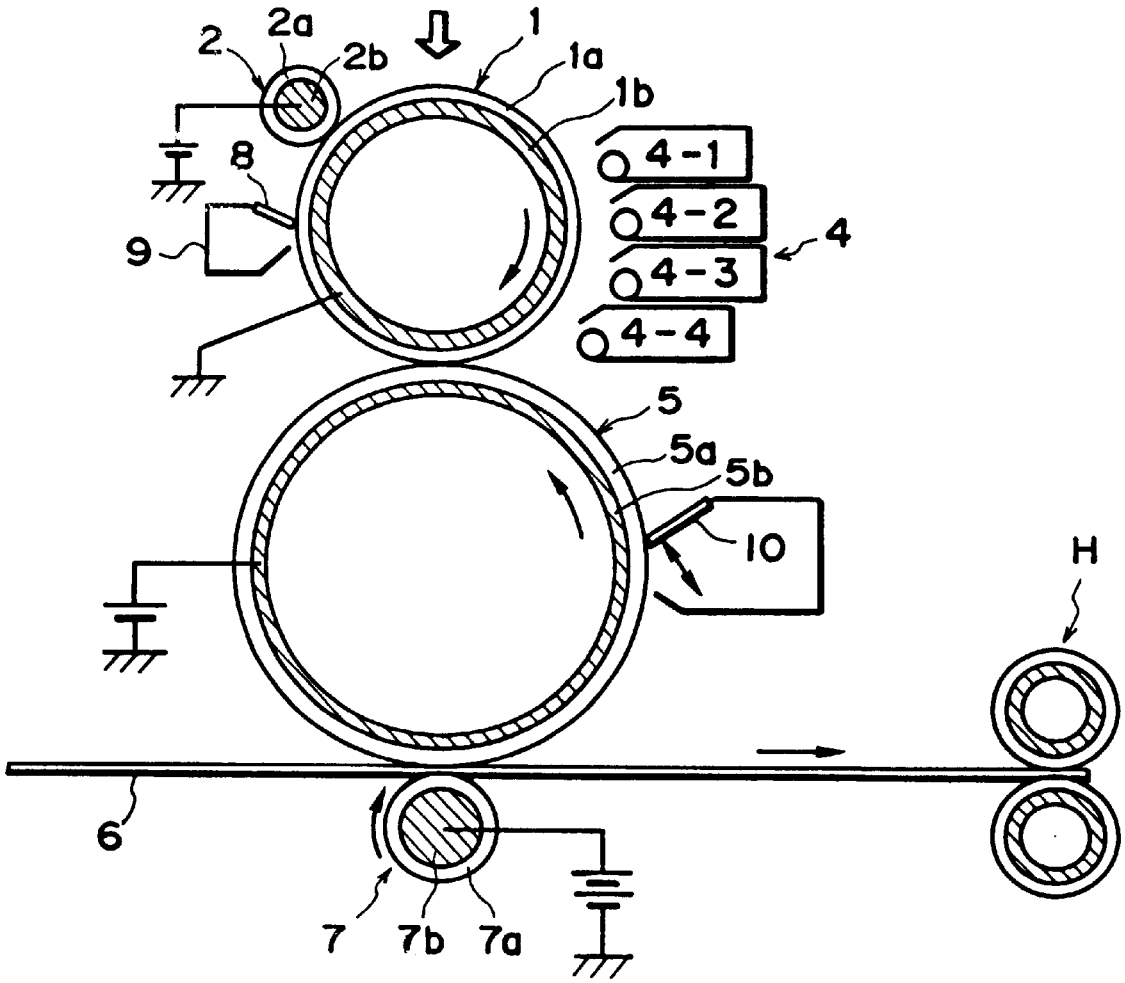
FIG. 1 schematically illustrates an example of image forming apparatus suitably used for practicing an embodiment of the image forming method of the invention.

According to our study, it has been discovered that a toner having very good low-temperature fixability and storage stability as well as excellent continuous image forming performances can be provided by using toner particles each having a sea-island-sea texture wherein a particle of wax component enclosed within a matrix of binder resin is caused contain a resin dispersed in a particulate form therein, and the residual monomer content in the toner particles is suppressed to at most 500 ppm according to a first embodiment of the present invention.

It has been also found that a toner exhibiting a good hue and a proper gloss is provided by using toner particles each having a texture wherein a particle of wax component is enclosed within a matrix of a binder resin, and a colorant is distributed in specific proportions to the wax particle and the binder resin according to a second embodiment of the present invention.

The toner according to the first embodiment (hereinafter sometimes referred to as the first toner) of the present invention comprises at least a binder resin, a colorant and a wax component, and each toner particle has a characteristic sectional microtexture as observed through a transmission electron microscope (TEM) that a particle (or particles) of the wax contains therein a resin in a particulate form and is in turn enclosed within the matrix of the binder resin.

By providing the toner particles with such a characteristic texture containing a wax particle in which the (binder) resin is a dispersed, the (binder) resin dispersed in the wax is quickly melted while being affected by the surrounding wax to be spread onto a recording sheet at the time of fixation thereby providing a very good low-temperature fixability. It is also assumed that a toner having such a sea-island-sea texture has a particularly large contact area between the resin and the wax, so that the influence of the wax is particularly enhanced to improve the low-temperature fixability. Further, as a portion of the binder resin is dispersed in the wax, the mechanical strength of the entire toner particle is enhanced while retaining the low-temperature fixability. As a result, the deterioration of and soiling with the toner in the image forming apparatus can be prevented, and good chargeability can be retained, thereby allowing formation of toner images with excellent dot reproducibility for a long term.

Further, in the toner according to the present invention, the wax is enclosed in a particulate form within the matrix of the binder resin so that the toner can exhibit good fixability and developing performance while retaining excellent anti-blocking property.

The first toner according to the present invention has a residual monomer content of at most 500 ppm, preferably at most 200 ppm, particularly preferably at most 100 ppm, based on the weight of the toner particles. If the residual monomer content in the toner particles is below 500 ppm, the mutual dissolution between the wax and the resin dispersed therein can be prevented to retain a phase separation therebetween, thus retaining the sea-island-sea texture and the effect thereof. In case where the residual monomer content in the toner particles exceeds 500 ppm, the wax and the resin dispersed therein dissolve with each other to lower the mechanical strength of the toner particles, thus failing to provide a sufficient durability, and monomer odor unpleasant to users is generated at the time of fixation. This is also liable to result in problems regarding the chargeability and anti-blocking property of the resultant toner.

The residual monomer referred to herein is liable to be contained in toner particles as a non-reacted portion of monomer for production of the binder resin or during toner production by the direct polymerization process as will be described later.

The reduction of residual monomer in toner particles may be achieved according to known methods, such as appropriate selection and control of addition of initiator and reaction temperature during polymerization for binder resin production or toner production according to the direct polymerization process, and/or distilling-off after the polymerization. Further, in the case of toner production according to the pulverization process, the removal of the residual monomer may be effected by application of a reduced pressure during hot-kneading of toner ingredients as by a kneader, etc. In the case of toner production by the polymerization process, the residual monomer can also be removed relatively effectively by spray drying. Particularly, in the case of toner production through the suspension polymerization process, it is also possible to remove the residual toner during heat-drying of polymerizate toner particles.

The residual monomer in toner particles may suitably be measured according to gas chromatography (GC).

A specific example of measurement according to the gas chromatography is shown below.

<Gas chromatography>

Apparatus: "GC-14A", available from Shimadzu Seisakusho K.K.

Column: Fused silica capillary column (available from J & W SCIENTIFIC Co.; sizes: 30 m×0.249 mm, liquid phase: DBWAX, film thickness: 0.25 μm)

Sample: 2.55 mg of DMF is used as the internal standard, and 100 ml of acetone is added thereto to form a solvent containing the internal standard. Then, 400 mg of a toner sample is added to an amount of the solvent to form 10 ml of a solution. After 30 min. of vibration by an ultrasonic vibrator, the solution is left standing for 1 hour and then filtered through a 0.5 μm-filter. The filtrate in 4 μm is used as an injection sample.

Detector: FID (split ratio=1:20)

Carrier gas: $N_2$ gas

Oven temperature: 70° C. to 200° C. (holding at 70° C. for 2 min., followed by heating at a rate of 5° C./min.

Injection port temperature: 200° C.

Detector temperature: 200° C.

Calibration curve: Several standard sample solutions are prepared by adding various amounts of an objective monomer to be measured into a solvent containing an internal standard (i.e., acetone containing DMF in 2.55 mg/100 ml); and are subjected to gas chromatography under the above-mentioned conditions to prepare a calibration curve plotting weight ratio on the ordinate versus areal ratio on the abscissa between the monomer and the DMF (internal standard).

The presence of a wax particle enclosed in the binder resin referred to herein may be confirmed in the following manner.

Sliced toner particle samples embedded within an epoxy resin are photographed through a transmission electron microscope (TEM), and 10 toner particle cross section samples each having a longer-axis diameter in the range of 0.9xD4 to 1.1xD4 with respect to a weight-average particle size (D4) of the toner particles measured according to a method described hereinafter and allowing the observation of a dispersed wax particle, are selected on the photographs. For each toner particle cross section showing a longer axis diameter R, a wax particle having the largest longer-axis diameter r among plural wax particles, if any, enclosed therein is selectively determined. For the 10 toner particle sectional views, an average of ratio r/R is taken, and if the average is in the range of 0.10–0.95 (i.e., $0.10 \leqq (r/R)_{ave.} \leqq 0.95$), the presence of wax particle(s) dispersively enclosed within toner particle(s) is confirmed. The dispersion or enclosure state as represented by the average of r/R being in the range of 0.15–0.90, particularly 0.25–0.90, is preferred in view of good anti-blocking property and low-temperature fixability.

Moreover, the dispersion or enclosure of (binder) resin in a particulate form within a wax particle may be confirmed in the following manner. Based on the toner particle sectional view samples used for determining the average of r/R, in each wax particle view showing the largest layer-axis diameter r, a (binder) resin particle having the largest longer-axis diameter a among plural (binder) resin particles, if any, dispersed or enclosed within the wax particle is selectively determined. For the 10 toner particle sectional views, an average of a/r is taken, and if the average is in the range of 0.05–0.70 (i.e., $0.05 \leqq (a/r)_{ave.} \leqq 0.70$), the dispersion or enclosure of (binder) resin in a particulate form within wax particle(s) is confirmed. A range of $0.10 \leqq (a/r)_{ave.} \leqq 0.50$ is further preferred.

According to the second embodiment of the toner of the present invention, one or more wax particles are enclosed within the matrix of a binder resin for each toner particle, and the colorant is dispersed in the binder resin and the wax in a specific ratio.

Because of such a texture wherein the colorant is taken into the dispersed wax particles, the colorant dispersed in the wax particles can be quickly spread together with the wax at the time of toner melting for fixation, whereby image having extremely good hue and having an appropriate gloss can be obtained. Simultaneously, the deterioration of the toner and the soiling of the image forming apparatus with the colorant can be prevented, and it becomes also possible to prevent the change in chargeability of the toner depending on environmental change even when a hygroscopic colorant, such as carbon black, is used, thus allowing stable maintenance of good chargeability and continuous production of toner images with excellent reproducibility for a long period.

In the present invention, the colorant may preferably be dispersed in the binder resin and the wax so as to provide a projection area (B) and a projection area (W), respectively, therein providing a ratio B/W of 0/100–80/20, more preferably 0/100–60/40, further preferably 0/100–40/60. If the projection area ratio B/W of the colorant dispersed in binder resin/wax is outside the range of 0/100–80/20, it becomes difficult to accomplish the effects of good image color hue, appropriate gloss and good environmental stability. Even if all the colorant particles are dispersed in the wax to provide a ratio B/W of 0/100, substantially no problem is caused, but images particularly excellent hue can be obtained in some cases if some portion of the colorant particles are also dispersed in the binder resin.

The projection area ratio B/W may be determined in the following manner.

First of all, the weight-average particle size (D4) of a toner sample is determined based on a particle size distribution measurement as described below (which is generally applicable to particle size distribution values for all the toner described herein). For example, Coulter Counter TA-II (available from Coulter Electronics, Inc.) may be used as a measurement apparatus together with an interface for outputting a number-basis distribution and a volume-basis distribution (available from Nikkaki K.K.) and a personal computer connected thereto, and an electrolytic solution comprising ca. 1% NaCl aqueous solution which may be prepared by dissolving a reagent-grade sodium chloride or commercially available as "ISOTON-II" (from Coulter Scientific Japan). For measurement, into 100 to 150 ml of the electrolytic solution, 0.1 to 5 ml of a surfactant (preferably an alkylbenzenesulfonic acid salt) is added as a dispersant, and 2–20 mg of a measurement sample is added. The resultant dispersion of the sample in the electrolytic solution is subjected to a dispersion treatment by an ultrasonic disperser for ca. 1–3 min., and then subjected to measurement of particle size distribution by using, e.g., the above-mentioned Coulter Counter TA-II equipped with an, e.g., 100 $\mu$m-aperture to obtain a number-basis particle size distribution of particles of 2–40 $\mu$m. From the distribution, the weight-average particle size (D4) and the volume-average particle size (D4) may be derived.

Similarly as in the above-mentioned observation of the wax dispersion state in the binder resin of the toner particles, sliced toner particles embedded within an epoxy resin are photographed through a transmission electron microscope (TEM), and 20 toner particle cross section samples which show a longer-axis diameter (R) within a range of 0.9xD4 to 1.1xD4 with respect to a weight-average particle size (D4) of the toner particles and in which a wax particle having the largest longer-axis diameter (r) enclosed in the toner particle concerned satisfying $0.10 \leqq r/R \leqq 0.95$ is observed, are selected on the photographs. The selected toner particle cross section samples on the photographs are subjected to image analysis by an image analyzer to measure the projection area (B) in the binder resin and the projection area (W) in the wax, respectively of the colorant particles, and calculate an average of the ratio B/W for the 20 toner particle cross section samples.

In order to positively disperse the colorant in the wax, various methods may be adopted. For example, it is possible to adopt a method when a wax having a high affinity to a colorant is used and the colorant is taken into the wax during a melt-kneading step for toner production; or a method wherein a wax having a high affinity to a colorant is used and the colorant is taken into the wax during polymerization for producing toner particles according to the direct polymerization process. The method according to the direct polymerization is particularly preferred since the ratio between the wax and the binder resin can be controlled at a relatively high latitude.

The cross section of toner particles defining (the first and second embodiments of) the toner according to the present invention may be observed through a TEM in the following manner. Sample toner particles are sufficiently dispersed in a cold-setting epoxy resin, which is then hardened for 2 days at 40° C. The hardened product is then dyed with triruthenium tetroxide and sliced into thin flakes by a microtome having a diamond cutter. The resultant thin flake samples in a number sufficient to provide a required number of toner particle cross sections are observed and photographed through a transmission electron microscope (TEM) at a magnification of $10^4$–$10^5$. The dyeing with triruthenium tetroxide may preferably be used in order to provide a contrast between the wax and the binder resin by utilizing some difference in crystallinity therebetween, thereby confirming a sea-island-sea texture.

Hereinbelow, the composition and properties of the toner according to the present invention (inclusive of the first and second embodiments thereof unless otherwise noted specifically) will be further described.

Various waxes may be used in the present invention. Examples thereof may include: paraffin wax and derivatives thereof, microcrystalline wax and derivatives thereof Fischer-Tropsche wax and derivatives thereof, polyolefin wax and derivatives thereof, and carnauba wax and derivatives thereof, and the derivatives may include oxides, and block or graft copolymerizates with vinyl monomers. Other wax materials may include higher fatty acids and metal salts thereof, higher aliphatic alcohols, higher aliphatic esters, aliphatic amide wax, ketone, hardened castor oil and derivatives thereof, vegetable waxes, animal waxes, mineral waxes, and petrolactam. A particularly preferred class of wax may include polyalkylene waxes having long-chain branches as represented by the following structural formula:

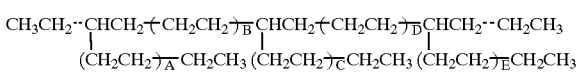

wherein A–E are independently a positive number of at least 1.

Such a wax may preferably show a maximum heat absorption peak in a temperature region of 40–130° C. on a DSC heat-absorption curve as measured on temperature increase by using a differential scanning calorimeter. The use of such a wax having a maximum heat-absorption peak in the temperature region, improves the low-temperature fixability and the releasability. If the maximum heat-absorption peak appears below 40° C., the wax is liable to show a weak cohesion, thus resulting in inferior anti-high-temperature offset characteristic and too high a gloss. On the other hand, a maximum heat-absorption peak above 130° C. is liable to result in too high a fixing temperature and a difficulty in providing a fixed image having an appropriately smoothened surface. This is particularly undesirable in the case of a color toner because of a lowering in the color miscibility. Further, in the case of the direct polymerization process for providing a toner including particle formation and polymerization in an aqueous medium, the use of such a wax having a high maximum heat-absorption peak temperature is liable to cause a difficulty, such as precipitation of the wax during the particle formation.

In the present invention, the addition amount of the wax is basically not restricted but may preferably be in the range of 0.5–30 wt. % of the toner.

The molecular weight distribution of a wax may be measured by gel permeation chromatography (GPC). As a specific example, 100 mg of a wax sample or a toner sample containing a wax is dissolved in 20 ml of tetrahydrofuran in 24 hours at room temperature, and the resultant solution is filtered through a solvent-resistant membrane filter having a pore diameter of 0.2 $\mu$m to provide a sample solution, which is subjected to measurement according to the following conditions:

Apparatus: High-speed GPC apparatus, "HLC 8120 GPC", available from Toso K.K.

Column: 7 columns of Shodex KF-801, 802, 803, 804, 805, 806 and 807 (available from Showa Denko K.K.) connected in series.

Eluent: tetrahydrofuran Flow rate: 1.0 ml/min.

Oven temperature: 40.0° C.

The calibration curve is prepared by using standard polystyrene resins ("TSK standard polystyrene F-850, F-450, F-288, F-128, F-80, F-40, F-20, F-10, F-4, F-2, F-1, A-5000, A-2500, A-1000, A-500, available from Toso K.K.).

In case where the wax is insoluble in THF and the above GPC measurement is impossible, THF is exchanged to a solvent, such as o-dichlorobenzene, and high-temperature GPC analysis at an oven temperature of ca. 130–150° C. may be performed to allow the measurement of a weight-average molecular weight of a wax.

Further, in case where the GPC measurement by using a toner per se is difficult, the toner sample may be subjected to 24 hours of Soxhlet extraction with a solvent such as tetrahydrofuran or toluene, and the filtrate is condensed by an evaporation, to provide a GPC sample.

Further, in case where the wax component and the binder resin have overlapping molecular weight regions and therefore the measurement of weight-average molecular weight of a wax is difficult, an organic solvent dissolving only one of the wax and the binder resin may be used to separate these components, and the separated wax may be subjected to GPC analysis for measuring a weight-average molecular weight.

The colorants usable in the present invention may include a yellow colorant, a magenta colorant, a cyan colorant, as may be selected from the groups of colorants described below, and also a black colorant which may comprise carbon black, a magnetic material, or a colorant showing black by color-mixing of yellow/magenta/cyan colorants as shown below.

Examples of the yellow colorant may include: condensed azo compounds, isoindolinone compounds, anthraquinone compounds, azo metal complexes, methin compounds and acrylamide compounds. Specific preferred examples thereof may include C.I. Pigment Yellow 12, 13, 14, 15, 17, 62, 74, 83, 93, 94, 95, 109, 110 111, 128, 129, 147, 168, and 180.

Examples of the magenta colorant may include: condensed azo compounds, diketopyrrolepyrrole compounds, anthraquinone compounds, quinacridone compounds, basic dye lake compounds, naphthol compounds, benzimidazole compounds, thioindigo compounds and perylene compounds. Specific preferred examples thereof may include: C.I. Pigment Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basic dye lake compounds.

Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants may preferably be used in a proportion of 1–20 wt. parts per 100 wt. parts of the binder resin.

The toner according to the present invention can also be used as a magnetic toner by using a magnetic material as a black colorant. Examples of the magnetic material usable for this purpose may include: iron oxides, such as magnetite, hematite and ferrite; metals, such as iron, cobalt and nickel, and alloys of these metals with aluminum, cobalt, copper, lead, magnesium, tin, zinc, antimony, beryllium, bismuth, cadmium, calcium, manganese, selenium, titanium, tungsten, and vanadium, and mixtures of these.

The magnetic material used in the present invention may preferably be a surface-modified one. Particularly, for use in toner production according to the polymerization process, the magnetic material may preferably be hydrophobized by a surface modifier having no polymerization-inhibiting action. Examples of such a surface modifier may include: silane coupling agents and titanium coupling agents.

The magnetic material may have a number-average particle size of at most 2 $\mu$m, preferably ca. 0.1–0.5 $\mu$m. The magnetic material may be contained in 20–200 wt. parts, preferably 40–150 wt. parts, per 100 wt. parts of the binder resin in the toner particles. The magnetic preferably have magnetic properties under application of 10 kilo-oersted, including a coercive force (Hc) of 20–300 oersted, a saturation magnetization ($\sigma_s$) of 50–200 emu/g and a residual magnetization ($\sigma_r$) of 2–20 emu/g.

The toner according to the present invention can contain a charge control agent. The charge control agent may be a known one and may preferably be one having a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids such as salicylic acid, alkylsalicylic acid, dialkylsalicylic acid, naphthoic acid, dicarboxylic acid and derivatives of these acids; polymeric compounds having a side chain comprising sulfonic acid or carboxylic acid; boron compound; urea compounds; silicon compound; and calixarene. Specific examples of the positive charge control agent may include: quaternary ammonium salts; polymeric compounds having a side chain comprising quaternary ammonium salts; guanidine compounds; and imidazole compounds.

The charge control agent used in the present invention may preferably be used in a proportion of 0.5–10 wt. parts per 100 wt. parts of the binder resin. However, the charge control agent is not an essential component for the toner particles used in the present invention. The charge control agent can be used as an optional additive in some cases. In the case of using two-component developing method, it is possible to utilize triboelectrification charge with a carrier. In the case of using a non-magnetic one-component blade coating developing method, it is possible to omit a charge control agent by positively utilizing a triboelectric charge through friction with a blade member or a sleeve member.

The toner particles used in the present invention may have a shape factor SF-1 of 100–160, preferably 100–140, and a shape factor SF-2 of 100–140, preferably 100–120, as measured by an image analyzer. It is particularly preferred that a ratio (SF-2)/(SF-1) is at most 1.0.

The shape factors SF-1 and SF-2 referred to herein are based on values measured in the following manner. Sample particles are observed through a field-emission scanning electron microscope ("FE-SEM S-800", available from Hitachi Seisakusho K.K.) at a magnification of 500, and 100 images of toner particles having a particle size (diameter) of at least 2 $\mu$m are sampled at random. The image data are inputted into an image analyzer ("Luzex 3", available from Nireco K.K.) to obtain averages of shape factors SF-1 and SF-2 based on the following equations:

$$SF\text{-}1=[(MXLNG)^2/AREA]\times(\pi/4)\times100,$$

$$SF\text{-}2=[(PERI)^2/AREA]\times(1/4\pi)\times100,$$

wherein MXLNG denotes the maximum length of a sample particle, PERI denotes the perimeter of a sample particle, and AREA denotes the projection area of the sample particle.

The shape factor SF-1 represents the roundness of toner particles, and the shape factor SF-2 represents the roughness of toner particles.

Toner particles having a shape factor SF-1 exceeding 160 are caused to have indefinite shapes resulting in a broad charge distribution and are also liable to be degraded by surface-abrasion within the developing apparatus, thus causing an image density lowering and image fog. Further, in case of SF-1 exceeding 160, the transfer efficiency is liable to be lowered, and the lowering in transfer efficiency becomes particularly remarkable in an image forming apparatus including an intermediate transfer member, wherein two times of transfer are included, i.e., a transfer from the image bearing member to the intermediate transfer member, and a transfer from the intermediate transfer member to a recording material.

A shape factor SF-2 of 100–140 is preferred so as to provide a high transfer efficiency. In case of SF-2 exceeding 140, the toner particle surface is not smooth but is provided with many unevennesses, thus being liable to lower the transfer efficiency. In case of the ratio (SF-2)/(SF-1) exceeding 1, the transfer efficiency is also liable to be lowered, particularly in an image forming apparatus including an intermediate transfer member.

A low transfer efficiency becomes problematic particularly in a full-color image forming apparatus using a plurality of toner images. In full-color image formation, it is rather difficult to effect uniform transfer of four-color toner images, so that the control of SF-1 and SF-2 becomes necessary in order to stably provide images with excellent color balance and free from color irregularity.

Further, in the case of using indefinitely shaped toner particles, the melt-sticking or filming of the toner can occur between the photosensitive member and the cleaning member, between the intermediate transfer member and the cleaning member, and on the surfaces of the image bearing member and the intermediate transfer member, thus being liable to cause a difficulty in matching with the image forming apparatus.

Further, in order to faithfully reproduce minute latent image dots for realizing a high image quality, the toner particles may preferably have a weight-average particle size (D4) of at most 10 $\mu$m, preferably 4–9 $\mu$m, further preferably 4–8 μm, and a variation coefficient of at most 35% based on the number-basis distribution. Toner particles having a weight-average particle size in excess of 10 μm are liable to cause melt-sticking onto the photosensitive member surface and other members inclusive of the intermediate transfer member. Toner particles having a weight-average particle size of below 4 μm are liable to by strongly attached to the image bearing member and the intermediate transfer member, thus causing a lowering in transfer efficiency. The difficulties are promoted if the toner particles have. a number-basis particle size variation coefficient ($A_{NV}$) in excess of 35% as calculated by the following formula:

$$\text{Variation coefficient } A_{NV}=[S/D_1]\times 100,$$

wherein S denotes a standard deviation in number-basis particle size distribution, and D1 denotes a number-average particle size (diameter) (μm), respectively of toner particles.

The binder resin constituting the toner according to the present invention may comprise a vinyl resin, a polyester resin, an epoxy resin, a styrene-butadiene copolymer, or a mixture of these resins.

The binder resin constituting the toner according to the present invention may comprise a vinyl resin, a polyester resin, an epoxy resin, a styrene-butadiene copolymer, or a mixture of these resins.

The binder resin used in the present invention may preferably contain components in a molecular weight region of 200–2000 only in a limited amount, if any, of at most 10 wt. %, based on the toner particles according to GPC measurement. If the amount of such low-molecular weight components is further increased, the resultant toner is liable to have lower chargeability and storage stability and result in inferior high-temperature offset property. Accordingly, the amount of such low-molecular weight components having molecular weights in the range of 200–2000, may further preferably be suppressed to at most 5 wt. % of the toner particles (as calculated by multiply the content of the components in the molecular weight region of a THF-soluble content according to GPC with a proportion of THF-soluble content in sample toner particles).

The molecular weight distribution of the binder resin can be measured according to GPC similarly as that of a wax sample but can also be measured, as desired according to other methods, inclusive of spectrocopy, such as nuclear magnetic resonance ($^1$H-NMR, $^{13}$C-NMR), infrared absorption spectroscopy (IR), Raman spectroscopy, ultraviolet absorption spectroscopy (UV), and mass spectroscopy (MS), elementary analysis, gas chromatography, liquid chromatography (HPLC), and other chemical analysis method.

The polyester resin constituting the binder resin may preferably comprise 45–55 mol. % of alcohol component and 55–45 mol. % of acid compound.

Examples of the alcohol component may include: diols, such as ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols and derivatives represented by the following formula (I):

(I)

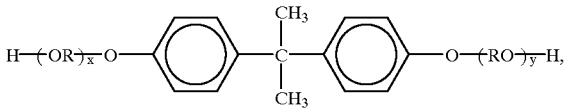

wherein R denotes an ethylene or propylene group, x and y are independently 0 or a positive integer with the proviso that the average of x+y is in the range of 0–10; diols represented by the following formula (II):

(II)

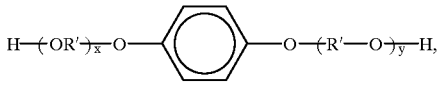

wherein R' denotes

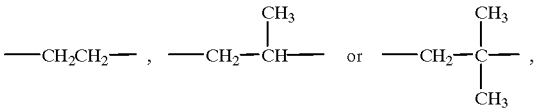

x' and y' are independently 0 or a positive integer with the proviso that the average of x'+y' is in the range of 0–10.

Examples of a dibasic acid providing at least 50 mol. % of the total acid components may include benzenedicarboxylic acids, such as phthalic acid, terephthalic acid and isophthalic acid, and their anhydrides; alkyldicarboxylic acids, such as succinic acid, adipic acid, sebacic acid and azelaic acid, and their anhydrides, and $C_0$–$C_{18}$; alkyl or alkenyl-substituted succinic acids, and their anhydrides; and unsaturated dicarboxylic acids, such as fumaric acid, maleic acid, citraconic acid and itaconic acid, and their anhydrides.

The alcohol components can include a polyhydric alcohol, such as glycerin, pentaerythriol, sorbitol, sorbitan, or oxyalkylene ether of novolak-type phenolic resin. The acid components can include a polybasic carboxylic acid, such as trimellitic acid, pyromellitic acid, benzophenonetetracarboxylic acid, or an hydride of these.

Preferred alcohol components may include bisphenol derivatives of the above-formula (I). Examples of preferred acid components may include: dicarboxylic acids, such as phthalic acid, terephthalic acid, isophthalic acid and its anhydride, succinic acid, n-dodecenylsuccinic acid and anhydrides of these, fumaric acid, maleic acid, and maleic anhydride. Preferred examples of crosslinking components may include: trimellitic anhydride, benzophenonetetracarboxylic acid, pentaerythritol, and oxyalkylene ether of novalak-type phenolic resin.

The polyester resin may preferably have a glass transition temperature of 40–90° C., more preferably 45–85° C.; a number-average molecular weight (Mn) of 1000–50000, more preferably 1500–20000; and a weight-average molecular weight (Mw) of 3000–$3\times10^6$, more preferably $10^4$–$2.5\times10^6$, further preferably $4\times10^4$–$2\times10^6$.

Examples of vinyl monomers constituting the vinyl resin may include: styrene; styrene derivatives, such as o-methylstyrene, m-methylstyrene, p-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, and p-n-dodecylstyrene; ethylenically unsaturated monoolefins, such as ethylene, propylene, butylene, and isobutylene; unsaturated polyenes, such as butadiene; halogenated vinyls, such as vinyl chloride, vinylidene chloride, vinyl bromide, and vinyl fluoride; vinyl esters, such as vinyl acetate, vinyl propionate, and vinyl benzoate; methacrylates, such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates, such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate, vinyl ethers, such as vinyl methyl ether, vinyl ethyl ether, and vinyl isobutyl ether; vinyl ketones, such as vinyl methyl ketone, vinyl hexyl ketone, and methyl isopropenyl ketone; N-vinyl compounds, such as N-vinylpyrrole, N-vinylcarbazole, N-vinylindole, and N-vinyl pyrrolidone; vinylnaphthalenes; acrylic acid derivatives or methacrylic acid derivatives, such as acrylonitrile, methacrylonitrile, and acrylamide; the esters of the above-mentioned α,β-unsaturated acids and the diesters of the above-mentioned dibasic acids. These vinyl monomers may be used singly or in combination of two or more species.

Further examples are carboxyl group-containing monomers, inclusive of: unsaturated dibasic acids, such as maleic acid, citraconic acid, alkenylsuccinic acid, fumaric acid, and mesaconic acid; unsaturated dibasic acid anhydrides, such as maleic anhydride, citraconic anhydride, itaconic anhydride, and alkenylsuccinic anhydride; half esters of unsaturated dibasic acids, such as monomethyl maleate, monoethyl maleate, monobutylmeleate, monomethyl citraconate, monoethyl citraconate, monobutyl citraconate, monomethyl itaconate, monomethyl alkenylsuccinate, monomethyl fumerate, and monomethyl mesaconate; unsaturated dibasic acid esters, such as dimethyl maleate, and dimethyl fumarate; α,β-unsaturated acid anhydrides, such as crotonic anhydride, cinnamic anhydride, anhydrides of such α,β-unsaturated acids and lower fatty acids; alkenylmalonic acid, alkenylglutric acid, alkenyladipic acid, and anhydrides and monoesters of these acids.

Further example are hydroxyl group-containing monomers, inclusive of: acrylate and methacrylate esters, such as 2-hydroxyethyl acrylate, 2-hydroxyethyl methacrylate, and 2-hydroxypropyl methacrylate; 4-(1-hydroxy 1-methylbutyl)styrene, and 4-(1-hydroxy-1-methylhexyl)styrene.

The vinyl resin may preferably have a glass transition temperature of 45–80° C., more preferably 55–70° C.; a number-average molecular weight (Mn) of $2500–5\times10^4$, more preferably $3000–2\times10^4$; and a weight-average molecular weight (Mw) of $10^4–1.5\times10^6$, more preferably $2.5\times10^4–1.25\times10^6$.

In the first embodiment of the toner according to the present invention, the resin component dispersed in the wax may comprises any kind of resin usable as a toner binder resin inclusive of polycarbonate resin or epoxy resin. The resin dispersed in the wax may be the same as or different from the binder resin constituting the matrix of toner particles.

The first embodiment of the toner according to the present invention may be produced through any process as far as it can provide toner particles having a sea-island-sea texture and having a residual monomer content of at most 500 ppm by weight based on the toner particles.

The second embodiment of the toner according to the present invention may also be produced through any process as far as it can provided toner particles having a texture of containing a wax particle dispersed or enclosed within the matrix of the binder resin and the colorant is dispersed in the wax particle and the binder resin in a ratio specified by the present invention.

Accordingly, as a process for producing the toner according to the present invention inclusive of the first and second embodiments, there may be adopted a pulverization process wherein the binder resin, the wax, the colorant, and other optional additives such as a charge control agent and other internal additives are uniformly kneaded and dispersed by a pressure kneader, an extruder or a media disperser, and the kneaded product is mechanically pulverized or caused to impinge onto a target in a jet stream to be pulverized into a desired toner particle size level, followed optionally by a step of smoothing and sphering the pulverized particles and then by classification into a narrower particle size distribution to form toner particles. In addition, it is also possible to adopt a process for obtaining spherical toner particles by spraying a molten mixture into air by using a disk or a multi-fluid nozzle as disclosed in JP-B 56-13945, etc.; a process for directly producing toner particles according to suspension polymerization as disclosed in JP-B 36-10231, JP-A 59-53856, and JP-A 59-61842; a dispersion polymerization process for directly producing toner particles in an aqueous organic solvent in which the monomer is soluble but the resultant polymer is insoluble; and a process for producing toner particles according to emulsion polymerization as represented by soap-free polymerization wherein toner particles are directly formed by polymerization in the presence of a water-soluble polymerization initiator.

For the purpose of the present invention, it is preferred to adopt the suspension polymerization process or the emulsion polymerization process, capable of relatively easily providing toner particles of at most 10 μm having shape factors SF-1 of 100–160 and SF-2 of 100–140 and a sharp particle size distribution. It is also possible to apply the preliminarily obtained polymerizate particles to a shape-adjusting treatment with media or by direct impingement onto a collision plate, or to coalescence of the polymerizate particles by freezing, salting-out or coagulation with particles having an opposite-polarity surface charge under a controlled pH in an aqueous medium. It is also possible to adopt a seed polymerization process wherein a monomer is further adsorbed onto once-obtained polymerizate particles and polymerized by using a polymerization initiator.

The toner particles according to the present invention (inclusive of the first and second embodiments thereof) may be produced by suspension polymerization in the following manner. Into a vinyl monomer, a wax, a colorant, a charge control agent, a polymerization initiator and another optional additive are added and uniformly dissolved or dispersed to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50–90° C. In order to provide the toner particles with improved mechanical strength and durability, it is possible to raise the temperature at a latter stage of the polymerization, and/or subject a part of the aqueous system to distillation in a latter stage of or after the polymerization in order to reduce the residual monomer content in the toner particles. After the reaction, the produced toner particles are washed, filtered out, and dried. In the suspension polymerization, it is generally preferred to use 300–3000 wt. parts of water as the dispersion medium per 100 wt. parts of the monomer composition. Incidentally, the reduction of the residual monomer content to at most 500 ppm may be accomplished by controlling the polymerization temperature, the amount of aqueous medium distilled off after the polymerization, the drying conditions, etc.

In the case of producing toner particles through the suspension direct polymerization process wherein droplets of a polymerizable monomer composition are polymerized in an aqueous medium, it is possible to control the average particle size and particle size distribution of the resultant toner particles by changing the species and amount of a hardly water-soluble inorganic salt or a dispersing agent functioning as a protective colloid; by controlling the mechanical process conditions, including stirring conditions such as a rotor peripheral speed, a number of passes and a stirring blade shape, and a vessel shape; and/or by controlling a weight percentage of solid matter in the aqueous dispersion medium.

In the case of toner production through the polymerization process, examples of the monomers selectively used may include: styrene monomers, such as styrene, o-, m- or p-methylstyrene, and m- or p-ethylstyrene; (meth)acrylate ester monomers, such as methyl (meth)acrylate, ethyl (meth) acrylate, propyl (meth)acrylate, butyl (meth)acrylate, octyl (meth)acrylate, dodecyl (meth)acrylate, stearyl (meth) acrylate, behenyl (meth)acrylate, 2-ethylhexyl (meth) acrylate, methylaminoethyl (meth)acrylate, and diethylaminoethyl (meth)acrylate; butadiene, isoprene, cyclohexene, (meth)acrylonitrile, and acrylamide. These monomers may be used singly or in mixtures so as to provide a polymer giving a theoretical glass transition temperature (Tg) described in Polymer Handbook, Second Edition, III, pp. 139–192 (John Wilery & Sons) of 40–75° C. If the theoretical glass transition temperature is below 40° C., the resultant toner is liable to suffer from difficulties with respect to storage stability and continuous image forming stability. On the other hand, in excess of 75° C., the toner shows an increased fixable temperature. This is particularly undesirable for color toners for forming full-color images, as the color mixability of the respective color toners is lowered to result in inferior color reproducibility and OHP images with lowered transparency.

In the case of producing toner particles according to the polymerization process containing a wax particle enclosed within the matrix or outer shell of the binder resin, it is particularly preferred to further incorporate a polar resin into the polymerizable monomer composition. Examples of such a polar resin used for this purpose may include: styrene-(meth)acrylic acid copolymer, maleic acid copolymer, unsaturated polyester saturated polyether resin, polycarbonate resin and epoxy resin.

In the toner production by direct polymerization, examples of the polymerization initiator may include: azo- or diazo-type polymerization initiators, such as 2,2'-azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobis-isobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while referring to their 10-hour half-life temperature.

In order to control the molecular weight of the resultant binder resin, it is also possible to add a crosslinking agent, a chain transfer agent, a polymerization inhibitor, etc.

In production of toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium, suitable for suspension polymerization.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

A preferred example of producing the toner particles according to the present invention (inclusive of the first and second embodiments) will now be described below.

Polyalkylene wax having a long-chain branch is used as a wax component together with a polymerizable monomer (mixture) comprising styrene and n-butyl acrylate. The wax and a first portion of the polymerizable monomer (in an amount identical or comparable to that of the wax) together with a colorant and other additives (such as a charge control agent and a polymerization initiator) are mixed with each other to prepare a polymerizable monomer composition, which is then dispersed in an aqueous medium, followed by heating to effect suspension polymerization. After cooling the resultant aqueous medium containing polymerizate particles, the remaining portion (nearly two times the first portion) of the polymerizable monomer together with an additional polymerization initiator is added gradually, and the system is further heated to effect the polymerization, thereby providing toner particles having a sea-island-sea texture. In order to produce such toner particles having a desired sea-island-sea texture, it is necessary to appropriately adjust the wax composition including its molecular weight, the ratios among the components of the monomer composition and the polymerization conditions (such as temperature, time and stirring speed). Further, in order to reduce the residual monomer content in the toner particles, it is also necessary to appropriately select the polymerization temperature, polymerization time and drying conditions. Further details of such selection will become apparent in view of Examples described hereinafter.

An embodiment of the image forming method according to the present invention wherein the toner according to the present invention (inclusive of the first and second embodiments thereof) is suitably used, will now be described with reference to FIG. 1, which illustrates an image forming apparatus including the intermediate transfer member.

Referring to FIG. 1, an electrostatic latent image bearing member (e.g., a photosensitive drum) 1 is uniformly charged by a charging means (e.g., a charging roller) 2 supplied with a voltage from an external supply. The charged image-bearing member 1 is exposed to image light (as represent by a downwardly directed arrow in FIG. 1) from exposure means (not shown) to form an electrostatic image thereon.

The charging means may comprise a contact charging means, such as a charging roller 2 as shown, or a non-contact charging means such as a corona charger. However, a contact charging means is preferred in view of effective uniform charging, simplicity and suppressed occurrence of ozone.

The charging roller 2 shown in FIG. 1 basically comprises a core metal 2*b* and an electroconductive elastic layer 2*a* covering the circumference of the core metal 2*b*, and is pressed against the image-bearing member 1 while being rotated following the rotation of the image bearing member 1.

Preferred process conditions for the charging roller 2 may include a roller abutting pressure of 5–500 g/cm, and supply of a DC-superposed AC voltage of 0.5–5 kVpp, a frequency of 50 Hz to 5 kHz and a DC-superposed voltage of ±0.2–±1.5 kV, or supply of a DC voltage alone of ±0.2–±5 kV.

Other contact charging means not necessitating a high voltage supply and capable of suppressing the occurrence of ozone, may include: a charging blade and an electroconductive brush.

Then, such an electrostatic image formed on the image bearing member 1 may be developed according to a known developing method according to, e.g., a magnetic brush developing scheme or a non-magnetic mono-component developing scheme by using any one of developing units 4-1, 4-2, 4-3 and 4-4 containing a developer comprising a cyan toner, a developer comprising a magenta toner, a developer comprising a yellow toner and a developer comprising a black toner, respectively, to form a first color toner image on the image bearing member 1.

The first color toner image formed on the image bearing member 1 is moved along with the rotation of the image bearing to reach a transfer nip where the image bearing member 1 and an intermediate transfer member 5 contact each other. While passing the transfer nip, the first color toner image is transferred onto the intermediate transfer member 5 under the action of an electric field formed by a primary transfer bias (voltage) applied to the intermediate transfer member 5. After the transfer, the surface of the image-bearing member 1 is cleaned by a cleaning means 9 comprising a cleaning blade 8. By repeating the above-mentioned cycle, second, third and fourth color toner images are successively formed on the image-bearing member 1 and superposedly transferred onto the intermediate transfer member 5, to form superposed color toner images on the intermediate transfer member 5 corresponding to an objective color image.

The intermediate transfer member 5 disposed to have a rotation axis parallel to that of the image bearing member 1 and contact the lower surface of the image-bearing member 1 and may preferably be rotated at an identical peripheral speed as the image-bearing member 1 at the position of the transfer nip.

The superposed toner images formed on the intermediate transfer member 5 are secondarily transferred onto a recording material 6, such as paper, by a transfer means (such as a transfer roller 7 as shown or a transfer belt). Such a transfer roller 7 or a transfer belt may preferably be moved at an identical peripheral speed as the intermediate transfer member 5 at the opposite position. The transfer means 7 may be disposed to contact the intermediate transfer member 5 directly or via a film or a belt. According to necessity, the surface of the intermediate transfer member 5 after the secondary transfer is cleaned by a cleaning means 10 disposed detachably from the intermediate transfer member 5. Thus, while the intermediate transfer member carries a toner image thereon, the cleaning member 10 is released away from the intermediate transfer member 5 so as not to disturb the toner image thereon.

Accordingly, in the second transfer step the toner image on the intermediate transfer member is transferred onto the recording material by the action of a transfer member abutted against the intermediate transfer member via the recording material.

Figure 5:
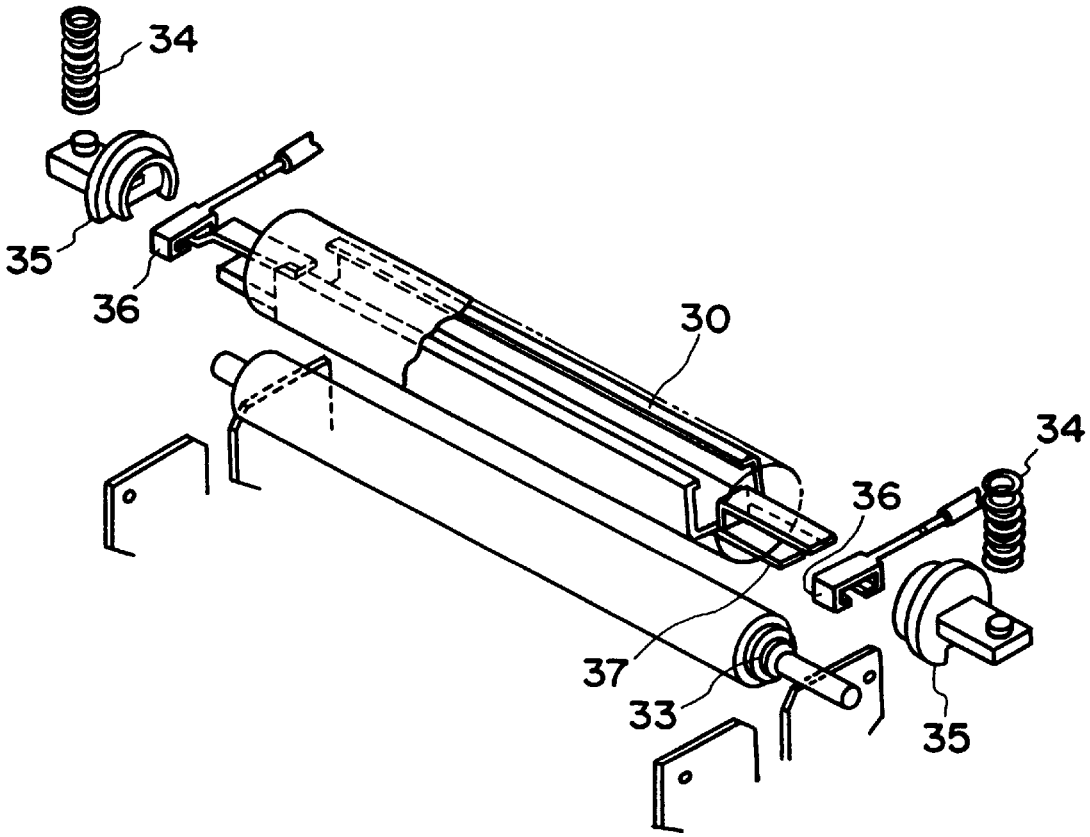
FIG. 5 is an exploded perspective view of essential parts of a heat-pressure fixing apparatus used in an embodiment of the invention.
Figure 6:
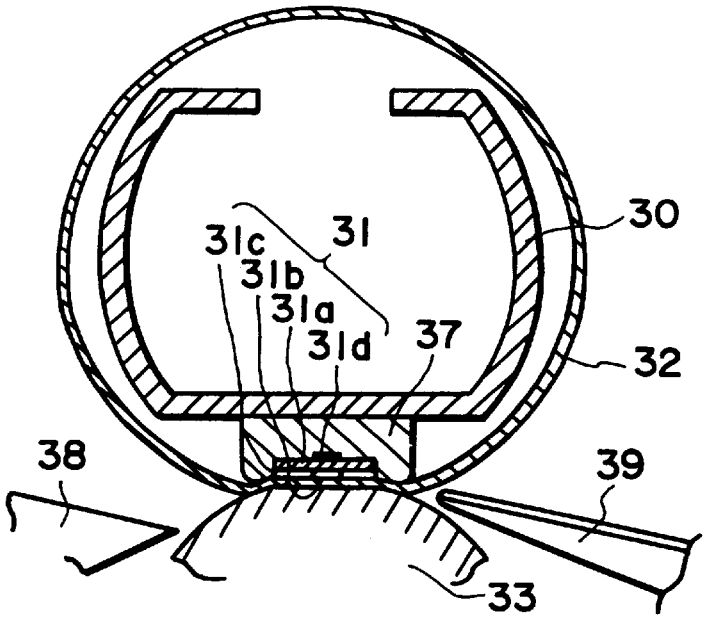
FIG. 6 is an enlarged sectional view of the fixing apparatus including a film in a non-driven state.

The recording material 6 carrying the transferred toner image is then conveyed to heat-pressure fixation means, inclusive of a hot roller fixation device H as shown in FIG. 1 comprising basically a heating roller enclosing a heat-generating member, such as a halogen heater, and a pressure roller comprising an elastic material pressed against the heating roller, and a hot fixation device for fixation by heating via a film (as shown in FIGS. 5 and 6, wherein reference numeral 30 denotes a stay; 31, a heating member; 31*a*, a heater substrate; 31*b*, a heat-generating member; 31*c*, a surface protective layer; 31*d*, a temperature-detecting element; 32, a fixing film; 33, a pressing roller; 34, a coil spring; 35, a film edge-regulating member; 36, an electricity-supplying connector; 37, an electricity interrupting member; 38, an inlet guide; and 39, an outlet guide (separation guide).

Therefore, the heat-fixing of the toner image is performed by a heat-fixing apparatus including a fixedly supported heating member, and a pressing member for pressing the recording material carrying the toner image against the heating member via a film.

Figure 2:
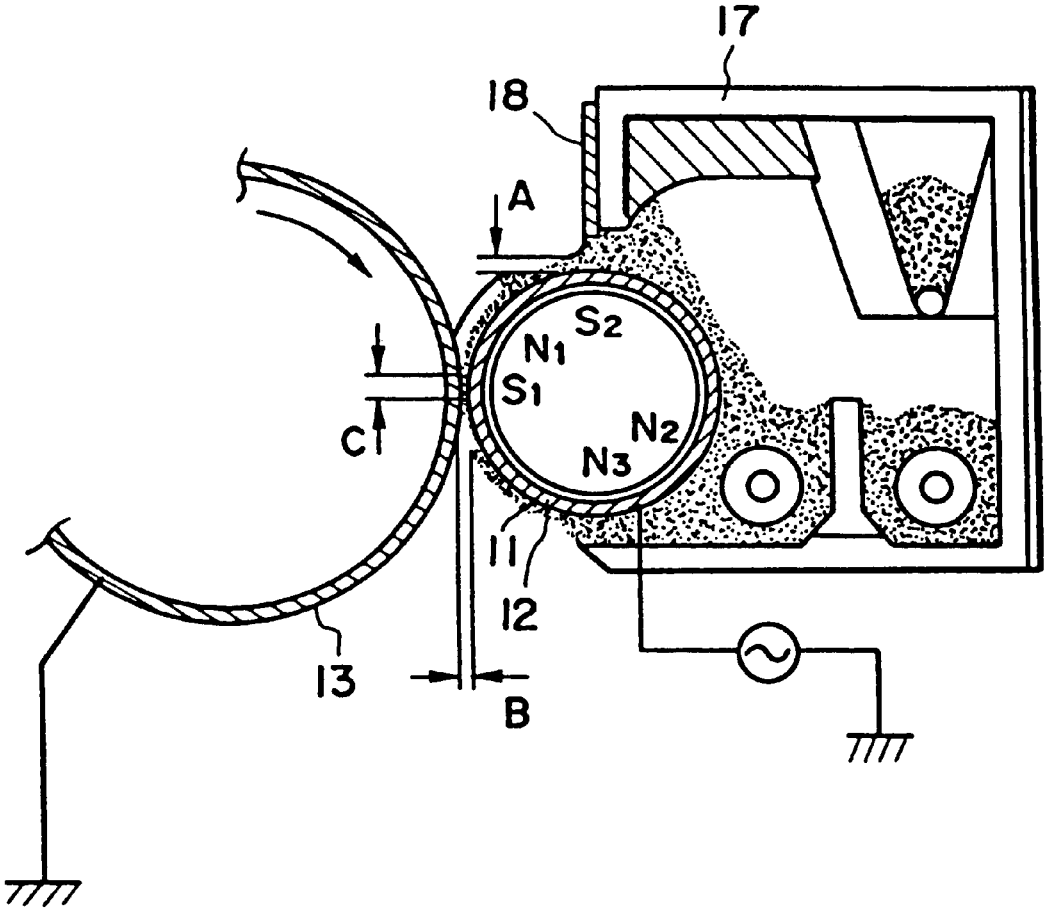
FIG. 2 is an enlarged sectional view of a developing apparatus using a two-component type developer used in an embodiment of the invention.

In case where the toner according to the present invention is blended with a magnetic carrier to form a. two-component type developer, the developer may be used for development by using a developing means as shown in FIG. 2. It is preferred to effect a development in a state where a magnetic brush contacts a latent image-bearing member, e.g., a photosensitive drum 13 under application of an alternating electric field. A developer-carrying member (developing sleeve) 11 may preferably be disposed to provide a gap B of 100–1000 μm from the photosensitive drum 13 in order to prevent the carrier attachment onto the photosensitive drum 13 and improve the image quality. If the gap is narrower than 100 μm, the supply of the developer is liable to be insufficient to result in a low image density. In excess of 1000 μm, the lines of magnetic force exerted by a developing pole S1 is spread to provide a low density of magnetic brush, thus being liable to result in an inferior dot reproducibility and a weak carrier constraint force leading to carrier attachment onto the photosensitive drum.

The alternating electric field may preferably have a peak-to-peak voltage of 500–5000 volts and a frequency of 500–10000 Hz, preferably 500–3000 Hz, which may be selected appropriately depending on the process. The waveform therefor may be appropriately selected, such as triangular wave, rectangular wave, sinusoidal wave or waveforms obtained by modifying the duty ratio. If the application voltage is below 500 volts it may be difficult to obtain a sufficient image density and fog toner on a non-image region cannot be satisfactorily recovered in some cases. Above 5000 volts, the latent image can be disturbed by the magnetic brush to cause lower image qualities in some cases.

By using a two-component type developer containing a well-charged toner, it becomes possible to use a lower fog-removing voltage (Vback) and a lower primary charge voltage on the photosensitive member, thereby increasing the life of the photosensitive member. Vback may preferably be at most 150 volts, more preferably at most 100 volts.

It is preferred to use a contrast potential (that is a potential difference between the image part and the non-image part on the photosensitive drum) of 200–500 volts so as to provide a sufficient image density.

The frequency can affect the process, and a frequency below 500 Hz may result in charge injection to the carrier, which leads to lower image qualities due to carrier attachment and latent image disturbance, in some cases. Above 10000 Hz, it is difficult for the toner to follow the electric field, thus being liable to cause lower image qualities.

In the developing method according to the present invention, it is preferred to set a contact width (developing nip) C of the magnetic brush on the developing sleeve 11 with the photosensitive drum 13 at 3–8 mm in order to effect a development providing a sufficient image density and excellent dot reproducibility without causing carrier attachment. If the developing nip C is narrower than 3 mm, it may be difficult to satisfy a sufficient image density and a good dot reproducibility. If broader than 8 mm, the developer is apt to be packed to stop the movement of the apparatus, and it may become difficult to sufficiently prevent the carrier attachment. The developing nip C may be appropriately adjusted by changing a distance A between a developer regulating member 18 and the developing sleeve 11 and/or changing the gap B between the developing sleeve 11 and the photosensitive drum 13.

Figure 3:
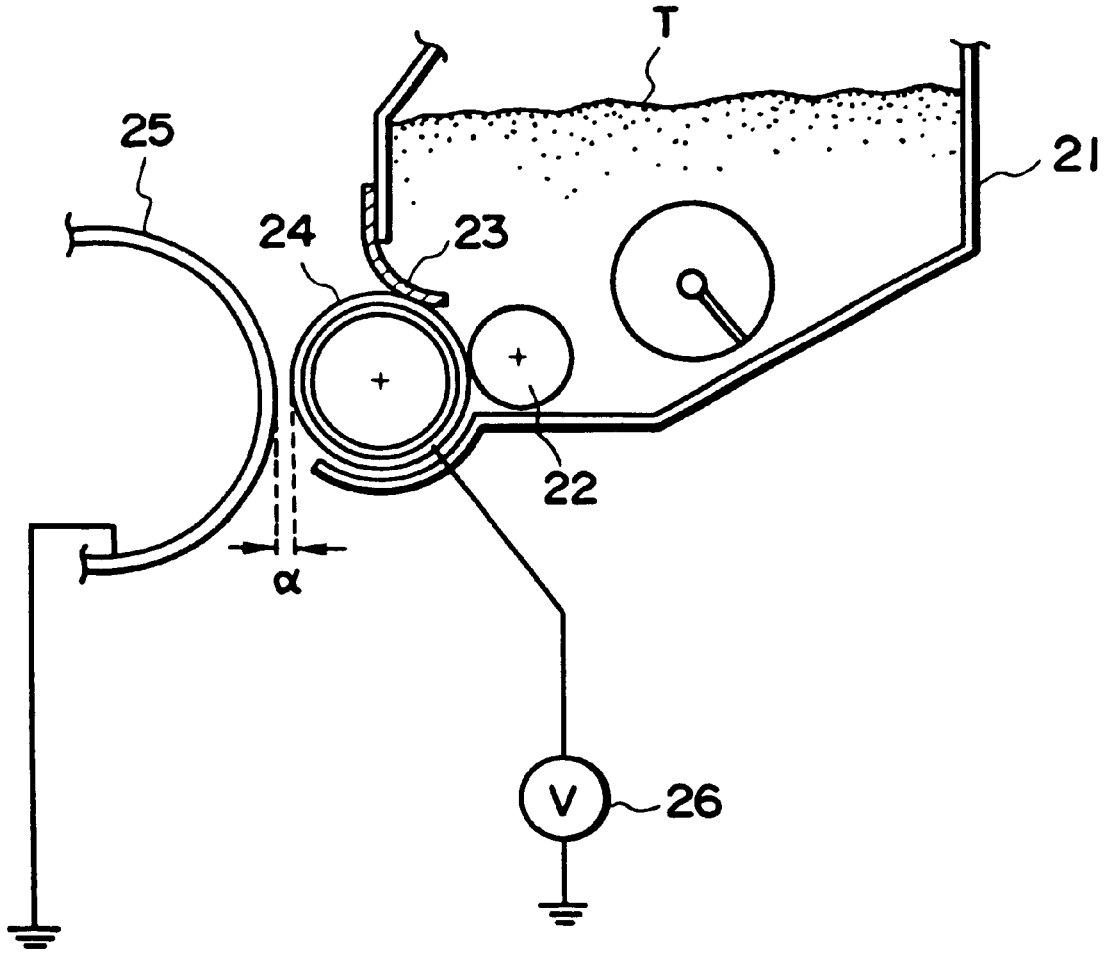
FIG. 3 is an enlarged sectional view of a developing apparatus using a mono-component type developer used in an embodiment of the invention.

The toner according to the present invention may also be realized as a non-magnetic or magnetic toner for a mono-component development method. FIG. 3 illustrates an example for such a development apparatus.

Referring to FIG. 3, an electrostatic image formed on an electrostatic image-bearing member (photosensitive drum) 25 by electrophotography or electrostatic recording may be developed with a toner T contained in a toner vessel 21 and applied on a non-magnetic developing sleeve (toner-carrying member) 24 comprising aluminum or stainless steel.

Almost a right half circumference of the developing sleeve is caused to always contact the toner T stored in the toner vessel 21, and the toner in proximity to the developing sleeve 24 is attached to and carried on the developing sleeve 24 under the action of a magnetic force generated by a magnetic field-generating means in the developing sleeve and/or an electrostatic force in the case of a magnetic toner, or under the action of an electrostatic force in the case of a non-magnetic toner.

The developing sleeve 24 may have a surface roughness Ra set to 1.5 μm or smaller, preferably 1.0 μm or smaller, further preferably 0.5 μm or smaller.

By setting the surface roughness Ra to at most 1.5 μm, the toner particle-conveying force of the developing sleeve is suppressed to allow the formation of a thin toner layer on the developing sleeve and increase the number of contents between the developing sleeve and the toner, to thereby improve the toner chargeability.

In case where the surface roughness Ra of the developing sleeve exceeds 1.5, it become difficult to form a thin layer of toner on the developing sleeve and improve the toner chargeability, so that the improvement in image quality becomes difficult to realize.

The surface roughness Ra of the developing sleeve refers to a center line-average roughness as measured by a surface roughness tester ("Surfcoder SE-30H", available from K.K. Kosaka Kenkyusho) according to JIS B0601. More specifically, the surface roughness Ra may be determined by taking a measurement length a of 2.5 mm along a center lien (taken on an x-axis) and taking a roughness on a y-axis direction to represent the roughness curve by a function of y=f(x) to calculate a surface roughness Ra (μm) from the following equation:

$$Ra = (1/a)\int_0^a |f(x)|dx.$$

If the surface-moving velocity of the developing sleeve is set to be 1.05–3.0 times the surface moving speed of the electrostatic image-bearing member, the toner layer on the developing sleeve receives an appropriate degree of stirring effect to realize a better faithful reproduction of an electrostatic image.

If the surface speed of the developing sleeve is below 1.05 times that of the electrostatic image-bearing member, such a toner layer stirring effect is insufficient, so that it becomes difficult to expect a good image formation. Further, in the case of forming a solid image requiring a large amount of toner over a wide area, the toner supply to the electrostatic image is liable to be insufficient to result in a lower image density. On the other hand, in excess of 3.0, the toner is liable to be excessively charged and cause difficulties, such as toner deterioration or sticking onto the toner-carrying member (developing sleeve).

The toner T stored in the hopper (toner vessel) 21 is supplied to the developing sleeve 24 by means of a supply member 22. The supply member may preferably be in the form of a supply roller comprising a porous elastic material or a foam material, such as soft polyurethane foam. The supply roller 22 is rotated at a non-zero relative velocity in a forward or reverse direction with respect to the developing sleeve, whereby the peeling of the toner (a portion of the toner not used for development) from the developing sleeve simultaneously with the tQner supply to the developing sleeve. In view of the balance between the toner supply and toner peeling, the supply roller 22 may preferably be abutted to the developing sleeve in a width of 2.0–10.0 mm, more preferably 4.0–6.0 mm. On the other hand, a large stress is liable to be applied to the toner to promote the toner deterioration or agglomeration or melt-sticking of the toner onto the developing sleeve and the supply roller, but, as the toner according to the present invention is excellent in flowability, releasability and durability, so that the toner is suitably used in the developing method using such a supply roller. The supply member can also comprise a brush member of resinous fiber of, e.g., nylon or rayon. The use of such a supply member is very effective for a non-magnetic monocomponent toner not capable of utilizing a magnetic constraint forth for toner application but can also be applicable to a monocomponent development method using a magnetic monocomponent method.

The toner supplied to the developing sleeve can be applied uniformly in a thin layer by a regulation member.

It is possible to constitute such a thin toner layer-regulating member as an elastic member, such as an elastic blade or an elastic roller, for applying a toner under pressure. FIG. 3, for example, shows an elastic blade 23 fixed at its upper but root portion to the developer vessel 21 and having its lower free length portion pressed at an appropriate pressure against the developing sleeve so as to extend in a reverse direction (as shown or in a forward direction). By using such an application means, it becomes possible to form a tight toner layer stable against an environmental change. The mechanism thereof has not been fully clarified as yet, but it is assumed that the forcible triboelectrification with the developing sleeve surface due to the elastic member allows a constant state charging regardless of a change in toner behavior accompanying an environmental change.

The elastic member may be abutted against the toner-carrying member at an abutting pressure of at least 0.1 kg/m, preferably 0.3–25 kg/m, further preferably 0.5–12 kg/m, in terms of a linear pressure in the direction of a generatrix of the toner-carrying member. As a result, it becomes possible to effectively disintegrate the toner to realize a quick charging of the toner. If the abutting pressure is below 0.1 kg/m, the uniform toner application becomes difficult to result in a broad toner charge distribution leading to fog and scattering. Above 25 kg/m, an excessive pressure is applied to the toner to cause toner deterioration or toner agglomeration, and a large torque becomes necessary for driving the toner-carrying member.

It is preferred to dispose the electrostatic image-bearing member 25 and the developing sleeve 24 with a gap a of 50–500 $\mu$m.

It is generally most preferred that the toner layer thickness is set to be thinner than the gap between the electrostatic image-bearing member and the developing sleeve, but the toner layer thickness can be set so that a portion of toner ears constituting the toner layer contacts the electrostatic image-bearing member.

As such a toner layer thickness-regulating member, it is also possible to use a rigid member, such as a doctor blade or a rigid roller, instead of an elastic member, such as the elastic blade or an elastic roller. In the case of using a doctor blade, it is preferred to dispose the blade with a gap of 50–400 $\mu$m from the developing sleeve.

Further, if a DC electric field and/or an AC electric field is applied to such a blade as a regulating member, or a supply roller or brush member as a supply member, it is also possible to exert a disintegrating power to the toner, thereby improving the uniform thin-layer application performance and uniform charging performance at the regulating position, and smoothly promoting the toner supply/peeling action, whereby good quality of images can be formed at a sufficient image density.

Further, by forming an alternating electric field between the electrostatic image-bearing member and the toner-carrying member from a bias voltage supply 26, it becomes possible to facilitate the toner movement from the toner-carrying member to the electrostatic image-bearing member, thereby providing a better quality of images. The alternating electric field may comprise a peak-to-peak voltage Vpp of at least 100 volts, preferably 200–3000 volts, further preferably 300–2000 volts, and a frequency f of 500–5000 Hz, preferably 1000–3000 Hz, further preferably 1500–3000 Hz. The alternating electric field may comprise a waveform of a rectangular wave, a sinusoidal wave, a sawteeth wave or a triangular wave. Further, it is also possible to apply an asymmetrical AC bias electric field having a positive wave portion and a negative wave portion having different voltages and durations. It is also preferred to superpose a DC bias component.

The toner according to the present invention exhibits a high transfer efficiency in the transfer steps to leave little transfer residual toner and also exhibits excellent cleanability, so that it does not readily cause filming on the electrostatic image-bearing member. Further, even when subjected to a continuous image formation test on a large number of sheets, the toner according to the present invention allows little embedding of the external additive at the toner particle surface, so that it can provide a good image quality for a long period. Particularly, the toner according to the present invention can be suitably used in an image forming apparatus equipped with a re-use mechanism as shown in FIG. 4 wherein a transfer residual toner on an electrostatic image-bearing member 40 is recovered by a cleaning blade 42 into a cleaning means 41, and the recovered residual toner is recycled via a screw 43, a recycle line 44 and a hopper 45 into a developing unit 46 for re-use by application on a developing sleeve 48.

Figure 4:
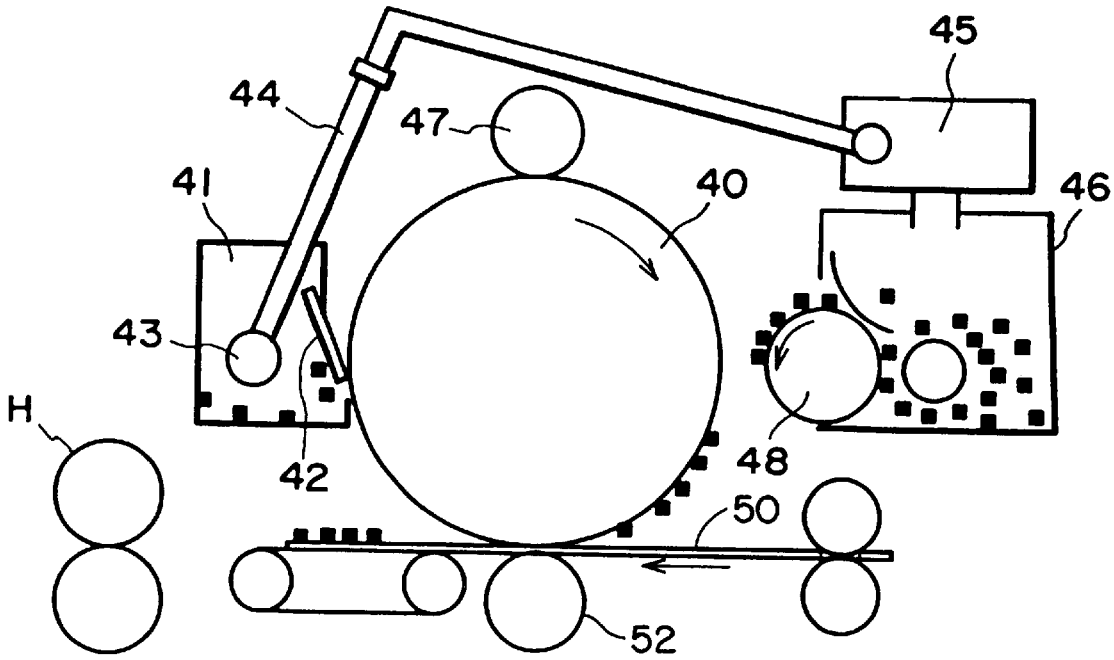
FIG. 4 is a schematic illustration of an image forming apparatus wherein a non-transferred portion of the toner is re-used.

As shown in FIG. 4, toner images formed on the image-bearing member 40 are transferred onto a recording material 50 by a transfer means, such as a transfer roller 52. Accordingly, the toner image on the image-bearing member is transferred onto the recording material by the action of a transfer member abutted against the image-bearing member via the recording material.

Referring again to FIG. 1, the electrostatic image-bearing member 1 may comprise a photosensitive drum (or a photosensitive belt) comprising a layer 1*a* of a photoconductive insulating material, such as a-Se, CdS, $ZnO_2$, OPC (organic photoconductor), and a-Si (amorphous silicon) formed on an electroconductive substrate 1*b*. The electrostatic image-bearing member 1 may preferably comprise an a-Si photosensitive layer or OPC photosensitive layer.

The organic photosensitive layer may be composed of a single layer comprising a charge-generating substance and a charge-transporting substance or may be a function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin, such as polycarbonate resin, polyester resin or acrylic resin, because such a binder resin is effective in improving transferability and cleaning characteristic and is not liable to cause toner sticking onto the photosensitive member or filming of external additives.

The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* can comprise a plastic pipe coated by electroconductive plating.

The medium resistance-elastic layer 5*a* may be a solid layer or a foamed material layer in which an electroconductivity-imparting substance, such as carbon black, zinc oxide, tin oxide or silicon carbide, is mixed and dispersed in an elastic material, such as silicone rubber, teflon rubber, chloroprene rubber, urethane rubber or ethylene-propylene-diene terpolymer (EPDM), so as to control an electric resistance or a volume resistivity at a medium resistance level of $10^5$–$10^{11}$ ohm.cm.

The developing sleeve or developer-carrying member (e.g., one denoted by 12 in FIG. 2) may preferably comprise a cylindrical or belt form-member of, e.g., stainless steel or aluminum, optionally surface-coated with a metal or resin, more preferably with a resin containing fine particles of a resin, a metal, carbon black or a charge control agent.

The charging roller or charging blade as a contact charging means may preferably comprise electroconductive rubber, optionally coated with a releasability-enhancing film of, e.g., nylon resin, PVDF (polyvinylidene fluoride) or PVDC (polyvinylidene chloride).

The toner layer thickness-regulating member may comprise an elastic material having a triboelectric chargeability in the triboelectrification series suitable for charging the toner to a desired polarity. Examples of suitable elastic materials may include: elastomers, such as silicone rubber, urethane rubber and nitrile-butadiene rubber; synthetic elastic resin, such as polyethylene terephthalate; and elastic metals, such as stainless steel, steel, and phosphor bronze. It is also possible to use a composite material of these.

Further, in case where the elastic member and the developer-carrying member (sleeve) are required to show an improved durability, it is preferred to coat a part of a metal elastic member to be abutted against the sleeve with a resin or rubber by pasting or application.

It is also possible to incorporate an organic material or an inorganic material into the elastic material as by melt-mixing or dispersion. For example, it is possible to control the toner-charging performance by adding metal oxide, metal powder, ceramics, carbon allotrope, whisker, inorganic fiber, pigment or surfactant. Particularly, in the case where the elastic member comprises a shaped body of rubber or resin, it is also preferred to incorporate fine powder of metal oxide, such as silica, alumina, titania, tin oxide, zirconia, or zinc oxide; carbon black, or a charge control agent generally used in a toner.

The toner layer thickness regulating member can also comprise a doctor blade, such as a metal blade or a magnetic blade, or a roller or sleeve of a rigid material such as metal, resin or ceramics.

As shown in FIG. 1, the transfer roller 7 may preferably comprise an electroconductive elastic layer 7*a* disposed on a peripheral surface of a core metal 7*b*, as a basic structure.

The intermediate transfer member 5 and the transfer roller 7 may comprise known materials as generally used. By setting the volume resistivity of the elastic layer 5*a* of the intermediate transfer member 5 to be higher than that of the elastic layer 7*b* of the transfer roller, it is possible to alleviate a voltage applied to the transfer roller 7. As a result, a good toner image is formed on the transfer-receiving material and the transfer-receiving material is prevented from winding about the intermediate transfer member 5. The elastic layer 5*a* of the intermediate transfer member 5 may preferably have a volume resistivity at least ten times that of the elastic layer 7*b* of the transfer roller 7.

The transfer roller 7 may comprise a core metal 7*b* and an electroconductive elastic layer 7*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 7*b* by a constant-voltage supply.

Hereinbelow, the present invention will be described more specifically based on Examples.

TONER PRODUCTION EXAMPLE AND COMPARATIVE PRODUCTION EXAMPLE

Toner Production Example 1

Into a 2-liter four-necked separable flask equipped with a high-speed stirrer ("TK Homomixer", available from Tokushu Kika Kogyo), 650 wt. parts of de-ionized water and 500 wt. parts of 0.1 mol/liter-$Na_3PO_4$ aqueous solution were charged, stirred at 12000 rpm and held under warming at 70° C. Into the system, 70 wt. parts of 0.1 mol/liter-$CaCl_2$ aqueous solution was gradually added to prepare an aqueous dispersion medium containing finely dispersed hardly water-soluble dispersion stabilizer $Ca_3(PO_4)_2$.

On the other hand, as a material to be dispersed, a polymerizable monomer composition was prepared in the following manner. That is, the following ingredients:

| | |
|---|---|
| Styrene | 39 wt. part(s) |
| n-Butyl acrylate | 11 wt. part(s) |
| Carbon black ($S_{BET}$ (BET specific surface area) = 80 $m^2/g$, $A_{oil}$ (oil-absorptivity) = 120 ml/100 g) | 10 wt. part(s) |
| Negative charge control agent | 2 wt. part(s) |

(Azo iron complex) were subjected to 3 hours of dispersion by an attritor (available from Mitsui Miike Kako K.K.). Then,

| | |
|---|---|
| Saturated polyester resin (Mp (peak molecular weight) = 4500, Tg = 70° C.) | 4 wt. part(s) |
| Low-molecular weight polyalkylene wax having long-chain branch (Mw = 16000, Mn = 1600, Mp = 4000, HAp (maximum heat-absorption peak) = 70° C.) | 50 wt. part(s) |
| 2,2'-Azobis(2,4-dimethylvaleronitrile) | 10 wt. part(s) |

were added to the above-formed dispersion, followed by heating at 70° C., to form a polymerizable monomer composition. Incidentally, the presence of long-chain branch in the above-mentioned polyalkylene wax was confirmed by $^{13}$C-NMR.

The thus-formed polymerizable monomer composition was then added to the above-prepared aqueous dispersion medium, and the system was subjected to 15 min. of high-speed stirring at 12000 rpm by the high-speed stirrer at 70° C. in a nitrogen atmosphere to form dispersion droplets of the polymerizable monomer composition. Thereafter, the high-speed stirrer was replaced by propeller stirring blades, and the system was held at 70° C. for 10 hours under stirring at 50 rpm, to form a suspension liquid containing polymerizable particles dispersed therein.

After cooling of the above suspension liquid, a mixture of the following ingredients was added dropwise thereto, and then the system was again heated to 70° C. and held at that temperature for 10 hours.

| | |
|---|---|
| Styrene | 88 wt. part(s) |
| n-Butyl acrylate | 12 wt. part(s) |
| Unsaturated polyester resin (Mp = 5200, Tg = 59° C.) | 1 wt. part(s) |
| 2,2'-Azobis(2,4-dimethylvaleronitrile) | 5 wt. part(s) |

Further, the system (interior of the flask) was reduced to a pressure of ca. 50 kPa by a vacuum pump, and the aqueous medium was held at 80° C. to effect 10 hours of distillation. Thereafter, the suspension liquid was cooled, and dilute hydrochloric acid was added thereto to remove the dispersion stabilizer, followed by recovery of polymerizate particles and several times of washing thereof with water. The resultant polymerizate particles were charged in a cylindrical vessel equipped with a jacket, followed by rotation of the cylindrical vessel while circulating warm water at 50° C. through the jacket and holding the interior of the cylindrical vessel at a reduced pressure of ca. 10 kPa, thereby effecting 10 hours of drying to obtain black Toner particles (A1).

The black Toner particles (A1) exhibited a weight-average particle size (D4) of 6.4 $\mu$m, a number-basis particle size variation coefficient ($A_{NV}$) of 25%, shape factors SF-1=127, SF-2=115, and (SF-2)/(SF-1)=0.91. Further, the binder resin in the toner particles exhibited a peak molecular weight (Mp) of $1.9\times10^4$ and a content in a GPC molecular weight region of 200–2000 ($C_{MW}\leqq2000$) of 2.4 wt. % based on the toner particles.

The dispersion states of the wax and the colorants in the black Toner particles (A1) were observed and photographed through a transmission microscope. A typical photograph thus taken exhibited a toner particle cross section of a sea-island-sea texture as shown in a schematic view of FIG. 7A, wherein a wax particle 72 was enclosed within the matrix of the binder resin 71, and further some particles 71 of binder resin and some colorant particles 73 were enclosed within the wax particle 72. Further,, the black Toner particles (A1) showed a wax dispersion state giving an average of r/R of 0.44 between r (maximum longer-axis diameter of wax particle(s) enclosed within each toner particle) and R (longer-axis diameter of the toner particle) and an inner binder resin-dispersion state giving an average of a/r of 0.31 between a (maximum longer-axis diameter of binder resin particle(s) enclosed with the wax particle giving the value r) and r. Further,the colorant particles were dispersed in both the matrix of the binder resin 71 and the wax particle 72 in projection areas (B) and (W) giving a ratio B/W of 20/80. Further, the residual monomer content $(\text{Monomer})_{res}$. in the black Toner particles (A1) was 50 ppm.

Magenta Toner particles (A2), cyan Toner particles (A3) and yellow Toner particles (A4) were prepared in the same manner as in the above-mentioned production of the black Toner particles (A1) except for using C.I. Pigment Red 202 (magenta colorant), C.I. Pigment Blue 15:3 (cyan colorant) and C.I. Pigment Yellow 17 (yellow colorant), respectively, instead of carbon black. Some physical properties of the respective Toner particles are inclusively shown in Table 1.

Figure 7A:
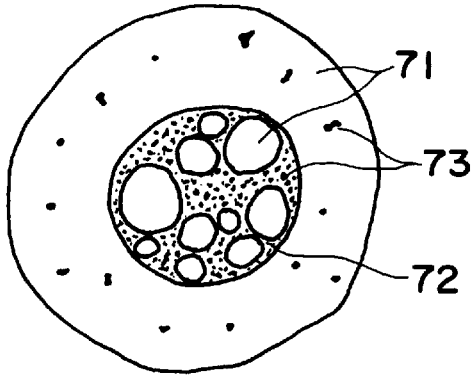
FIG. 7A is a microscopic sectional illustration of an embodiment of a toner particle according to the invention.

As a result of TEM observation of Toner particles (A2) to (A4), these toner particles respectively showed the above-mentioned sea-island-sea texture as schematically shown in FIG. 7A.

The above-prepared Toner particles (A1) to (A4) were subjected to the following storage stability (storability) test whereby all toner particles exhibited a good result without lowering the flowability.

<Storability>

5.0 g of sample toner particles were charged in a plastic cup and placed still in a hot air drying oven set at 50.0° C. After 3 hours of standing, the toner particles in the cup were left cooling to room temperature and then observed with eyes for evaluation of the storage stability according to the following standard.

A: The flowability was retained without lowering.

B: The flowability was lowered but could be restored if the cup was rotated.

C: Agglomerates of toner particles were observed.

D: Caking occurred.

100 wt. parts each of the above Toner particles (A1) to (A4) were respectively blended with 2 wt. parts of hydrophobic silica fine powder ($S_{BET}$ 200 $m^2/g$) by a Henschel mixer to prepare Toners (A1) to (A4), respectively, of the present invention. Then, 6 wt. parts each of Toners (A1) to (A4) were respectively blended with 94 wt. parts of resin-coated magnetic ferrite carrier (D4=50 $\mu$m) to prepare Developers (A1) to (A4), respectively, of the two-component type for the magnetic brush developing scheme.

Toner Production Example 2

Toner particles (B) were prepared in the same manner as in the production of the black Toner particles (A1) in Production Example 1 except the polymerizate particles recovered from the aqueous medium and washing with water were dried by 40 hours of hot air drying at 40° C. under normal pressure.

Properties of Toner particles (B) are also shown in Table 1.

As a result of TEM observation, Toner particles (B) exhibited the sea-island-sea texture as schematically shown in FIG. 7A. Toner particles (B) 20 further provided a carbon black dispersion projection area ratio B/W of 30/70.

Toner (B) and Developer (B) of the two-component: type were prepared from Toner particles (B) similarly as in Production Example 1.

Toner Production Example 3

Toner particles (C) were prepared in the same manner as in the production of the black Toner particles (A1) in Production Example 1 except the polymerizate particles recovered from the aqueous medium and washing with water were dried by 20 hours of hot air drying at 35° C. under normal pressure.

Properties of Toner particles (C) are also shown in Table 1.

As a result of TEM observation, Toner particles (C) exhibited the sea-island-sea texture as schematically shown in FIG. 7A. Toner particles (C) further provided a carbon black dispersion projection area ratio B/W of 41/59.

Toner (C) and Developer (C) of the two-component type were prepared from Toner particles (C) similarly as in Production Example 1.

Toner Production Example 4

Toner particles (D) were prepared in the same manner as in the production of the black Toner particles (A1) in Production Example 1 except for omitting the use of the saturated polyester resin and the unsaturated polyester resin.

Properties of Toner particles (D) are also shown in Table 1.

As a result of TEM observation, Toner particles (D) exhibited the sea-island-sea texture as schematically shown in FIG. 7A. Toner particles (D) further provided a carbon black dispersion projection area ratio B/W of 21/79.

Toner (D) and Developer (D) of the two-component type were prepared from Toner particles (D) similarly as in Production Example 1.

Comparative Toner Production Example 1

Into a 2-liter four-necked separable flask equipped with a high-speed stirrer ("TK Homomixer", available from Tokushu Kika Kogyo), 650 wt. parts of de-ionized water and 500 wt. parts of 0.1 mol/liter-$Na_3PO_4$ aqueous solution were charged, stirred at 12000 rpm and held under warming at 70° C. Into the system, 70 wt. parts of 0.1 mol/liter-$CaCl_2$ aqueous solution was gradually added to prepare an aqueous dispersion medium containing finely dispersed hardly water-soluble dispersion stabilizer $Ca_3(PO_4)_2$.

On the other hand, as a material to be dispersed, a polymerizable monomer composition was prepared in the following manner. That is, the following ingredients:

| | |
|---|---|
| Styrene | 39 wt. part(s) |
| n-Butyl acrylate | 11 wt. part(s) |
| Carbon black ($S_{BET}$ = 80 $m^2$/g, $A_{oil}$ = 120 ml/100 g) | 10 wt. part(s) |
| Negative charge control agent | 2 wt. part(s) |

(Azo iron complex) were subjected to 3 hours of dispersion by an attritor (available from Mitsui Miike Kako K.K.). Then, Low-molecular weight polyalkylene wax used in Toner Production

| | |
|---|---|
| Example 1 (HAp = 70° C.) | 50 wt. part(s) |
| 2,2'-Azobis(2,4-dimethylvaleronitrile) | 10 wt. part(s) |

were added to the above-formed dispersion, followed by heating at 70° C., to form a polymerizable monomer composition.

The thus-formed polymerizable monomer composition was then added to the above-prepared aqueous dispersion medium, and the system was subjected to 15 min. of high-speed stirring at 12000 rpm by the high-speed stirrer at 70° C. in a nitrogen atmosphere to form dispersion droplets of the polymerizable monomer composition. Thereafter, the high-speed stirrer was replaced by propeller stirring blades, and the system was held at 70° C. for 10 hours under stirring at 50 rpm, to form a suspension liquid containing polymerizable particles dispersed therein.

After cooling of the above suspension liquid, a mixture of the following ingredients was added dropwise thereto, and then the system was again heated to 70° C. and held at that temperature for 10 hours.

| | |
|---|---|
| Styrene | 88 wt. part(s) |
| n-Butyl acrylate | 12 wt. part(s) |
| 2,2'-Azobis(2,4-dimethylvaleronitrile) | 5 wt. part(s) |

Thereafter, the suspension liquid was cooled, and dilute hydrochloric acid was added thereto to remove the dispersion stabilizer, followed by recovery of polymerizate particles and several times of washing thereof with water. The resultant polymerizate particles were then dried by 10 hours of hot air drying at 35° C. under normal pressure to prepare Comparative Toner particles (a).

Properties of Comparative Toner particles (a) are also shown in Table 1.

As a result of TEM observation, Comparative Toner particles (a) exhibited the sea-island-sea texture as schematically shown in FIG. 7A. Comparative Toner particles (a) further provided a carbon black dispersion projection area ratio B/W of 72/28.

Comparative Toner (a) and Comparative Developer (a) of the two-component type were prepared from Comparative Toner particles (a) similarly as in Production Example 1.

Comparative Toner Production Example 2

Into a 2-liter four-necked separable flask equipped with a high-speed stirrer ("TK Homomixer", available from Tokushu Kika Kogyo), 650 wt. parts of de-ionized water and 500 wt. parts of 0.1 mol/liter-$Na_3PO_4$ aqueous solution were charged, stirred at 12000 rpm and held under warming at 70° C. Into the system, 70 wt. parts of 0.1 mol/liter-$CaCl_2$ aqueous solution was gradually added to prepare an aqueous dispersion medium containing finely dispersed hardly water-soluble dispersion stabilizer $Ca_3(PO_4)_2$.

On the other hand, as a material to be dispersed, a polymerizable monomer composition was prepared in the following manner. That is, the following ingredients:

| | |
|---|---|
| Styrene | 39 wt. part(s) |
| n-Butyl acrylate | 11 wt. part(s) |
| Carbon black ($S_{BET}$ = 80 $m^2$/g, $A_{oil}$ = 120 ml/100 g) | 10 wt. part(s) |
| Negative charge control agent | 2 wt. part(s) |

(Azo iron complex) were subjected to 3 hours of dispersion by an attritor (available from Mitsui Miike Kako K.K.). Then,

| | |
|---|---|
| Paraffin wax (HAp = 70° C.) | 50 wt. part(s) |
| 2,2'-Azobis(2,4-dimethylvaleronitrile) | 10 wt. part(s) |

were added to the above-formed dispersion, followed by heating at 70° C., to form a polymerizable monomer composition.

The thus-formed polymerizable monomer composition was then added to the above-prepared aqueous dispersion medium, and the system was subjected to 15 min. of high-speed stirring at 12000 rpm by the high-speed stirrer at 70° C. in a nitrogen atmosphere to form dispersion droplets of the polymerizable monomer composition. Thereafter, the high-speed stirrer was replaced by propeller stirring blades, and the system was held at 70° C. for 10 hours under stirring at 50 rpm, to form a suspension liquid containing polymerizable particles dispersed therein.

After cooling of the above suspension liquid, dilute hydrochloric acid was added thereto to remove the dispersion stabilizer, followed by recovery of polymerizate particles and several times of washing thereof with water. The resultant polymerizable particles were then dried by 20 hours of hot air drying at 35° C. under normal pressure to prepare Comparative Toner particles (b).

Properties of Comparative Toner particles (b) are also shown in Table 1.

Figure 7B:
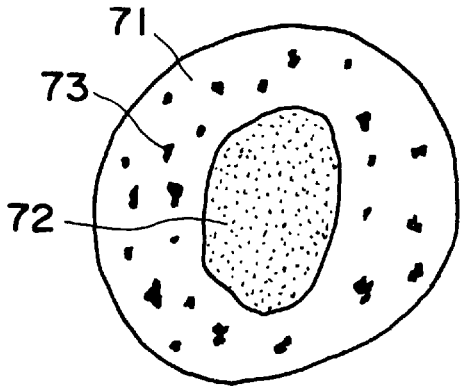
FIGS. 7B and 7C are microscopic sectional illustrations of comparative toner particles.

As a result of TEM observation, Comparative Toner particles (b) exhibited a dispersion state as schematically shown in FIG. 7B, wherein a wax particle 72 was enclosed within the matrix of binder resin 71 but no carbon black dispersion was observed in the wax particle 72.

Comparative Toner (b) and Comparative Developer (b) of the two-component type were prepared from Comparative Toner particles (b) similarly as in Production Example 1.

Comparative Toner Production Example 3

Comparative Toner particles (c) were prepared in the same manner as in Comparative toner Production Example 2 except for using paraffin wax (HAp=57° C.) instead of the paraffin wax (HAp=70° C.).

Properties of Comparative Toner particles (c) are also shown in Table 1.

As a result of TEM observation, Comparative Toner particles (c) exhibited a wax and colorant dispersion state as schematically shown in FIG. 7B wherein a wax particle 72 was enclosed within the matrix of binder resin 71 but the carbon black was dispersed solely in the binder resin 71 and not in the wax particle 72.

Comparative Toner (c) and Comparative Developer (c) of the two-component type were prepared from Comparative Toner particles (c) similarly as in Production Example 1.

Comparative Toner Production Example 4

| | |
|---|---|
| Styrene/n-butyl acrylate resin ($Mp = 2 \times 10^4$, Mw/Mn = 1.8, Tg = 60° C.) | 150 wt. part(s) |
| Saturated polyester resin used in Production Example 1 | 4 wt. part(s) |
| Unsaturated polyester resin used in Production Example 1 | 10 wt. part(s) |
| Negative charge control agent used in Production Example 1 | 2 wt. part(s) |
| Paraffin wax (HAp = 60° C.) | 6 wt. part(s) |

The above ingredients were melt-kneaded through a twin-screw extruder, and the kneaded product after cooling was coarsely crushed by a hammer mill, followed by fine pulverization by a jet mill and classification, to obtain classified powder (d).

Properties of the classified powder (d) are also shown in Table 1.

Figure 7C:
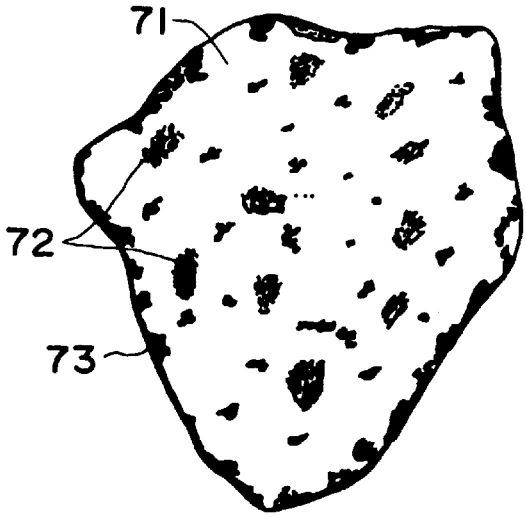

As a result of TEM observation, the classified powder (d) exhibited a wax and colorant dispersion state as schematically shown in FIG. 7C wherein the wax 72 and the colorant 73 were both finely dispersed in the matrix of the binder resin 71, and the dispersion of carbon black in a wax particle was not observed.

Comparative Toner (d) and Comparative Developer (d) of the two-component type were prepared from the classified powder (d) similarly as in Production Example 1.

Comparative Toner Production Example 5

| | |
|---|---|
| Styrene/n-butyl acrylate resin ($Mp = 1.3 \times 10^4$, Mw/Mn = 1.6, Tg = 60° C.) | 150 wt. part(s) |
| Saturated polyester resin used in Production Example 1 | 4 wt. part(s) |
| Unsaturated polyester resin used in Production Example 1 | 10 wt. part(s) |
| Negative charge control agent used in Production Example 1 | 2 wt. part(s) |
| Paraffin wax (HAp = 60° C.) | 6 wt. part(s) |

The above ingredients were melt-kneaded through a twin-screw extruder, and the kneaded product after cooling was coarsely crushed by a hammer mill, followed by fine pulverization by a jet mill and classification, to obtain classified powder (e).

Properties of the classified powder (e) are also shown in Table 1.

As a result of TEM observation, the classified powder (e) exhibited a wax and colorant dispersion state as schematically shown in FIG. 7C wherein the wax 72 and the colorant 73 were both finely dispersed in the matrix of the binder resin 71, and the dispersion of carbon black in a wax particle was not observed.

Comparative Toner (e) and Comparative Developer (e) of the two-component type were prepared from the classified powder (e) similarly as in Production Example 1.

TABLE 1

| | Toner properties | | | | | | | | |
|---|---|---|---|---|---|---|---|---|---|
| | Shape factors | | | | | | | | |
| Toner particles | SF-1 | SF-2 | (SF-1) /(SF-2) | D4 (μm) | Mp | $C_{MW} \leqq 2000$ (wt. %) | $(Monomer)_{res}$ (wt. ppm) | $(r/R)_{av.}$ | Stor-ability |
| A1 | 125 | 115 | 0.92 | 6.8 | 16000 | 2.4 | 50 | 0.44 | A |
| A2 | 127 | 123 | 0.97 | 6.9 | 16000 | 1.6 | 55 | 0.48 | A |
| A3 | 123 | 121 | 0.98 | 7.1 | 17000 | 3.5 | 49 | 0.51 | A |
| A4 | 130 | 120 | 0.92 | 7.1 | 17000 | 2.8 | 53 | 0.46 | A |
| B | 131 | 116 | 0.86 | 7.0 | 17000 | 4.2 | 180 | 0.48 | A |
| C | 129 | 117 | 0.91 | 7.2 | 16000 | 5.9 | 420 | 0.38 | A |
| D | 129 | 117 | 0.91 | 7.4 | 17000 | 3.7 | 95 | 0.46 | B |
| a | 127 | 120 | 0.94 | 7.0 | 17000 | 3.8 | 2680 | 0.45 | B |
| b | 128 | 120 | 0.94 | 6.9 | 17000 | 4.8 | 1800 | 0.42 | B |
| c | 132 | 120 | 0.91 | 6.8 | 17000 | 4.6 | 1720 | 0.44 | B |
| d* | 170 | 146 | 0.85 | 9.2 | 20000 | 6.3 | 440 | <0.05 | D |
| e* | 169 | 143 | 0.85 | 9.3 | 13000 | 14 | 430 | <0.05 | D |

*Pulverized and classified powder.

Example 1

Developers (A1) to (A4), respectively, of the two-component type were evaluated in an image forming test by using an image forming apparatus having an organization as roughly shown in FIG. 1 where each of developing units 4-1 to 4-4 had a structure as illustrated in FIG. 2.

More specifically, a photosensitive drum 1 had a photosensitive layer 1*b* on a substrate 1*a*, was rotated in a direction of an indicated arrow and was charged to a surface potential of ca. −600 volts by a charging roller 2 having an electroconductive elastic layer 2*a* or a core metal 2*b* and rotated in an opposed contacting relationship with the photosensitive drum 1. The charged photosensitive drum 1 was exposed to image light supplied from a polygonal mirror carrying on-off image data based on digital image data to form an electrostatic latent image having an exposed light part potential of −100 volts and a dark potential of −600 volts.

For performance evaluation of Developer (A1), Developer (A1) was incorporated in a developing unit (4-1) and used to develop the electrostatic image on the photosensitive drum 1 according to the reversal development mode to form a toner image of Toner (A1). The toner image was transferred onto an intermediate transfer member 5, and the transfer residual toner on the photosensitive member 1 was cleaned by a cleaning member 8 and recovered in a residual toner vessel 9.

The intermediate transfer member 5 comprised a pipe-form core metal 5*b* coated with an electroconductive elastic layer 5*a* comprising a nitrile-butadiene rubber (NBR) and carbon black dispersed therein so as to provide a hardness of 30 deg. (according to JIS K-6301) and a volume resistivity of $10^9$ ohm.cm. A transfer current of ca. 5 $\mu$A required for transfer of a toner image from the photosensitive drum 1 to the intermediate transfer member 5 was obtained by applying a voltage of +500 volts to the core metal 5*b*.

The toner image on the intermediate transfer member 5 was transferred onto a recording sheet 6 by operating a transfer roller 7 and fixed onto the recording sheet 6 by a heat-fixing apparatus H.

The transfer roller 7 had an outer diameter of 20 mm and comprised a 10 mm-dia. core metal 7*b* coated with an elastic layer 7*a* comprising a foam of ethylene-propylene-diene terpolymer (EPDM) and electroconductive carbon sufficiently dispersed therein so as to provide a volume resistivity of $10^6$ ohm.cm and a hardness of 35 deg (JIS K-6301). The transfer roller 7 was supplied with a voltage to flow a transfer current of 15 $\mu$A.

The heat-fixing apparatus H was a heating roller type fixing apparatus not equipped with an oil applicator and including an upper roller and a lower roller respectively coated with a surface layer of fluorine-containing resin and having a roller diameter of 60 mm. The fixing temperature was 130° C. and the nip width was set to 7 mm.

Therefore, the heat-fixing of the toner image is performed by a heat-fixing apparatus free from supply of an offset-preventing liquid or a cleaner for the heat-fixing apparatus.

Under the above set conditions, the image forming test was performed in both an environment of normal temperature/normal humidity (25° C./60% RH) and an environment of high temperature/high humidity (35° C./85% RH) after standing for one weak in each environment. The image formation (printing) was performed continuously on 5000 sheets according to a single-color-mode while replenishing Toner (A1) as required (i.e., in a mode of promoting the toner consumption without providing a rest period to the developing unit). The resultant printed images were evaluated with respect to items described hereinafter.

Further, Developer (A1) was also evaluated with respect to matching with (the respective parts of) the image forming apparatus used.

The results of the above evaluation are shown in Tables 2 and 3 together with those of Examples and Comparative Examples described hereinafter.

Further, by charging the developing units 4-2 to 4-4 with Developers (A2) to (A4), respectively, in addition to Developer (A1) charged in the developing unit 4-1, a full-color image forming test was performed. High-quality images excellent in transparency and saturation and free from color irregularity were obtained. No problem regarding the matching with the image forming apparatus was observed.

Examples 2–4

The evaluation by the single-color mode image forming test was performed in the same manner as in Example 1 except for using Developers (B)–(D), respectively, instead of Developer (A1). The results are inclusively shown in Tables 2 and 3.

Comparative Examples 1 to 5

The evaluation by the single-color mode image forming test was performed in the same manner as in Example 1 except for using Comparative Developers (a) to (e), respectively, instead of Developer (A1). The results are inclusively shown in Tables 2 and 3.

TABLE 2

| | | Image Forming Performance | | | | |
|---|---|---|---|---|---|---|
| | | 25° C./60% RH | | 35° C./80% RH | | |
| Ex. or Comp. Ex. | Developer | Image density | Fog | Image density | Fog | Fixability |
| Ex. 1 | (A1) | A | A | A | A | A |
| Ex. 2 | (B) | A | A | A | A | A |
| Ex. 3 | (C) | A | B | A | B | A |
| Ex. 4 | (D) | A | B | A | A | A |
| Comp. Ex. 1 | (a) | B | C | C | C | B |
| Comp. Ex. 2 | (b) | B | B | B | C | B |
| Comp. Ex. 3 | (c) | B | B | B | C | B |
| Comp. Ex. 4 | (d) | C | D | D | D | D |
| Comp. Ex. 5 | (e) | D | D | D | D | C |

TABLE 3

| | Matching with Members of Image Forming Apparatus | | | | |
|---|---|---|---|---|---|
| Ex. or Comp. Ex | Developer | Developing sleeve | Photosensitive drum | Intermediate transfer member | Fixing apparatus |
| Ex. 1 | (A1) | A | A | A | A |
| Ex. 2 | (B) | A | A | A | A |
| Ex. 3 | (C) | B | A | A | A |
| Ex. 4 | (D) | B | B | A | A |
| Comp. Ex. 1 | (a) | C | C | B | C |
| Comp. Ex. 2 | (b) | C | C | B | C |
| Comp. Ex. 3 | (c) | C | C | B | C |

TABLE 3-continued

| Matching with Members of Image Forming Apparatus | | | | | |
|---|---|---|---|---|---|
| Ex. or Comp. Ex | Developer | Developing sleeve | Photosensitive drum | Intermediate transfer member | Fixing apparatus |
| Comp. Ex. 4 | (d) | D | D | D | D |
| Comp. Ex. 5 | (e) | D | D | D | D |

Example 5 and Comparative Example 6

Performances of Toner (A1) and Comparative Toner (a) were respectively evaluated with respect to items similar to those in Example 1 by using, instead of the developing apparatus shown in FIG. 2, a developing apparatus shown in FIG. 3 wherein the toner carrying member 3 was moved at a circumferential speed three times that of the photosensitive drum 25 according to an intermittent mode wherein each printing on one sheet was followed by a pause period of 10 sec. and a 2–3 sec. of preliminary operation for re-start-up of the developing apparatus for promoting the toner deterioration, while replenishing a fresh toner as required. The performance tests were performed by using toners after standing for one week in respective environments.

Further, printing of a white solid image was performed on 100 sheets, and thereafter the toner melt-sticking onto the toner layer thickness-regulating member was evaluated, in the normal temperature/normal humidity environment.

The toner-carrying member 24 had a surface roughness Ra of 1.5 and the toner regulating-blade 23 comprised a base sheet of phosphor bronze coated with an urethane rubber sheet and a nylon coating layer for abutting the toner carrying member. The results are inclusively shown in Tables 4 and 5.

TABLE 4

| Image Forming Performance | | | | | | |
|---|---|---|---|---|---|---|
| | | 25° C./60% RH | | 35° C./80% RH | | |
| Ex. or Comp. Ex. | Toner | Image density | Fog | Image density | Fog | Fixability |
| Ex. 5 | (A1) | A | A | A | A | A |
| Comp. Ex. 6 | (a) | C | B | C | C | B |

TABLE 5

| Matching with Members of Image Forming Apparatus | | | | | | |
|---|---|---|---|---|---|---|
| Ex. or Comp. Ex | Toner | Developing sleeve | Photosensitive drum | Intermediate transfer member | Toner layer thickness-regulating member | Fixing apparatus |
| Ex. 5 | (A1) | A | A | A | A | A |
| Comp. Ex. 6 | (a) | C | C | C | C | B |

Example 6 and Comparative Example 7

Performance evaluation of Toner (A1) and Comparative Toner (a) was performed by using a commercially available laser beam printer ("LBP-EX", mfd. by Canon K.K.) after remodeling of attaching a re-use mechanism to form an apparatus system as shown in FIG. 4 wherein a residual toner on a photosensitive drum 40 was scraped off by a cleaner blade 41 abutted against the photosensitive drum 40 into a cleaner 41 and resent via a recycle pipe 44 equipped with a conveyer screw 43 and a hopper 45 to a developer for re-use thereof. The photosensitive drum 40 was charged by a primary charging roller 47 comprising a 12 mm-dia. electroconductive carbon-dispersed rubber roller coated with a nylon. layer abutted at a pressure of 50 g/cm, and exposed to laser light image at a resolution of 600 dpi to form an electrostatic image having a dark-part potential $V_D$=−700 volts and a light-part potential $V_L$=−200 volts. The toner-carrying member 48 comprised a developing sleeve surfaced with a carbon black-dispersed resin coating layer having a surface roughness Ra of 1.1 and was rotated at a circumferential speed 1.1 times that of the photosensitive drum 40. The developing sleeve 48 was disposed with a gap of 270 $\mu$m from the photosensitive drum 40, and a urethane rubber blade was abutted against thereto as a toner thickness regulating member. An AC-superposed DC bias voltage was applied to the developing sleeve.

A toner image transferred onto a recording sheet was fixed by a heat-fixing apparatus H having a detailed structure as illustrated in FIGS. 5 and 6 including a heating member 31 having a surface temperature of 130° C. at its temperature detector 31*d* and supplied with a pressure of 8 kg from a silicone rubber foam pressure roller 33 over a nip of 6 mm via a fixing film 32 comprising a 60 $\mu$m-thick heat-resistant film coated with a release layer of high molecular weight-type PTFE with an electroconductive substance dispersed therein on its surface contacting the recording sheet.

After standing for one week in each test environment of normal temperature/normal humidity (25° C./60% RH) and high temperature/high humidity (35° C./85% RH), each of Toner (A1) and Comparative Toner (b) was tested for image formation according to an intermittent mode as described with reference to Example 5. The performance evaluation was performed with respect to items similar to those in Example 1, and the results thereof are inclusively shown in Tables 6 and 7 below.

TABLE 6

| Image Forming Performance | | | | | | |
|---|---|---|---|---|---|---|
| | | 25° C./60% RH | | 35° C./80% RH | | |
| Ex. or Comp. Ex. | Toner | Image density | Fog | Image density | Fog | Fixability |
| Ex. 6 | (A1) | A | A | A | A | A |
| Comp Ex. | (a) | B | C | B | C | B |

TABLE 7

| Matching with Members of Image Forming Apparatus | | | | | |
|---|---|---|---|---|---|
| Ex. or Comp. Ex | Toner | Developing sleeve | Photosensitive drum | Toner layer thickness-regulating member | Fixing apparatus |
| Ex. 6 | (A1) | A | A | A | A |
| Comp. Ex. 6 | (a) | C | C | C | B |

The items of evaluation of Developers or Toners described above and evaluation standards thereof are as follows.

[Output image evaluation]

<1> Image density

A printed-out image on a 100th-sheet in the test environment of normal temperature/normal humidity or a 300th-sheet in the test environment of high temperature/high humidity was measured with respect to an image density by a Macbeth reflective densitometer relative to a print-out image of a white ground portion having an original density of 0.00 according to the following standard:

A: ≧1.40

B: ≧1.35 and <1.40

C: ≧1.00 and <1.35

D: <1.00

<2> Fog

A printed-out image on a 100th-sheet in the test environment of normal temperature/normal humidity or a 300th-sheet in the test environment of high temperature/high humidity was measured with respect to a fog density (%) based on a difference in whiteness (reflectance) between a white ground portion of a printed-out image and transfer paper per se before printing based on values measured by using a reflective densitometer ("REFLECTOMETER" available from Tokyo Denshoku K.K.)

A: <1.5%

B: ≧1.5% and <2.5%

C: ≧2.5% and <4.0%

D: ≧4%

<3> Fixability

A fixed toner image on a 100-th sheet of paper (128 $gm^2$) in the test environment of normal temperature/normal humidity was rubbed with a soft tissue paper (lens-cleaning paper) under a load of 50 $g/cm^2$ to measure a decrease (%) in image density for evaluation of the fixability.

A: <5%

B: ≧5% and <10%

C: ≧10% and <20%

D: ≧20%

[Evaluation of matching with members of the image forming apparatus]

<1> Matching with a developing sleeve

After the print-out test, the state of occurrence of residual toner sticking onto the developing sleeve surface was evaluated with eyes.

A: Residual toner sticking was not observed.

B: Almost no sticking was observed.

C: Some sticking was observed.

D: Much sticking was observed.

<2> Matching with a photosensitive drum

After the print-out test, the damages on the photosensitive drum surface and the state of occurrence of residual toner sticking onto the drum surface were evaluated with eyes.

A: No damage or toner sticking was observed.

B: Slight damage was observed.

C: Toner sticking and damage were observed.

D: Much sticking was observed.

<3> Matching with an intermediate transfer member

After the print-out test, the state of damages and residual toner sticking on the surface of the intermediate transfer member were evaluated with eyes.

A: Not observed.

B: Surface residual toner was observed.

C: Sticking and damage were observed.

D: Much sticking was observed.

<4> Matching with a fixing device

After the print-out test, the state of damage and residual toner sticking on the fixing film were evaluated with eyes.

A: Not observed.

B: Slight sticking was observed.

C: Sticking and damage were observed.

D: Much sticking was observed.

<5> Matching with a toner layer thickness-regulating member.

After the print-out test, the state of toner melt-sticking onto the regulating member was observed with eyes.

A: No melt-sticking was observed.

B: Almost no melt-sticking was observed.

C: Some melt-sticking was observed.

D: Much melt-sticking was observed.

What is claimed is:

1. A toner comprising:

toner particles each containing a binder resin, a colorant and a wax; wherein each toner particle has such a microtexture as to provide a cross section exhibiting a matrix of the binder resin, and a particle of the wax enclosed within the matrix, and the colorant is dispersed to provide a projection area (B) in the binder resin and a projection area (W) in the wax giving a ratio B/W of 0/100–60/40, respectively, as observed through a transmission microscope (TEM); wherein the wax is present in amounts from 0.5 to 30 wt. % based on the weight of the toner, and wherein the wax particles are enclosed within the toner particles to provide an average of ratio r/R from 0.10–0.95, where R represents a longer axis diameter of a cross-section of the toner particle and r represents the largest longer axis diameter of a wax particle enclosed in each said toner particle.

2. The toner according to claim 1, wherein the ratio B/W is 0/100 to 40/60.

3. The toner according to claim 1, wherein the toner particles have a shape factor SF-1 of 100–160 and a shape factor SF-2 of 100–140.

4. The toner according to claim 1, wherein the toner particles have a shape factor SF-1 of 100–140 and a shape factor SF-2 of 100–120.

5. The toner according to claim 1, wherein the toner particles have a shape factor ratio (SF-2)/(SF-1) of at most 1.0.

6. The toner according to claim 1, wherein the colorant comprises carbon black.

7. The toner according to claim 1, wherein the toner particles have a residual monomer content of at most 500 ppm by weight of the toner particles.

8. The toner according to claim 1, wherein the toner particles have a residual monomer content of at most 200 ppm by weight of the toner particles.

9. The toner according to claim 1, wherein the toner particles have a residual monomer content of at most 100 ppm by weight of the toner particles.

10. An image forming method comprising:

a charging step of charging an image-bearing member, an electrostatic image forming step of forming an electrostatic image in the charged image-bearing member;

a developing step of developing the electrostatic image with a toner carried on a developer-carrying member for forming a toner image on the image-bearing member, a transfer step of transferring the toner image on the image-bearing member onto a recording material, and a fixing step of heat-fixing the toner image on the recording material; wherein the toner comprises toner particles each containing a binder resin, a colorant and a wax;

each toner particle has such a microtexture as to provide a cross-section exhibiting a matrix of the binder resin, and a particle of the wax enclosed within the matrix, and the colorant is dispersed to provide a projection area (B) in the binder resin and a projection area (W) in the wax giving a ratio B/W of 0/100–60/40, respectively, as observed through a transmission microscope (TEM); wherein the wax is present in amounts from 0.5 to 30 wt. % based on the weight of the toner, and wherein the wax particles are enclosed within the toner particles to provide an average of ratio r/R from 0.10–0.95, where R represents a longer axis diameter of a cross-section of the toner particle and r represents the largest longer axis diameter of a wax particle enclosed in each said toner particle.

11. The method according to claim 10, wherein the developer-carrying member is a developing sleeve and the developing sleeve has a surface roughness Ra of at most 1.5 μm and is moved at a circumferential speed which is 1.05–3 times that of the image-bearing member in the developing step.

12. The method according to claim 10, wherein a magnetic blade or metal blade is disposed opposite to and with a gap from the developer carrying member.

13. The method according to claim 10, wherein an elastic blade is abutted against the developer-carrying member.

14. The method according to claim 10, wherein the developing is performed while applying an alternating electric field between the developer-carrying member and the image-bearing member disposed with a spacing from each other.

15. The method according to claim 10, wherein the image-bearing member is charged by a charging member supplied with a voltage from an external voltage supply and contacting the image bearing member.

16. The method according to claim 10, wherein the toner image on the image-bearing member is transferred onto the recording material by the action of a transfer member abutted against the image-bearing member via the recording material.

17. The method according to claim 10, wherein the heat-fixing of the toner image is performed by a heat-fixing apparatus free from supply of an offset-preventing liquid or a cleaner for the heat-fixing apparatus.

18. The method according to claim 10, wherein the heat-fixing of the toner image is performed by a heat-fixing apparatus including a fixedly supported heating member, and a pressing member for pressing the recording material carrying the toner image against the heating member via a film.

19. The method according to claim 10, performed by an image forming apparatus equipped with a re-use mechanism for recovering a transfer residual toner remaining on the image-bearing member, and re-using the recovered toner in the developing step.

20. The method according to claim 10, wherein the ratio B/W is 0/100 to 40/60.

21. The method according to claim 10, wherein the toner particles have a shape factor SF-1 of 100–160 and a shape factor SF-2 of 100–140.

22. The method according to claim 10, wherein the toner particles have a shape factor SF-1 of 100–140 and a shape factor SF-2 of 100–120.

23. The method according to claim 10, wherein the toner particles have a shape factor ratio (SF-2)/(SF-1) of at most 1.0.

24. The method according to claim 10, wherein the colorant comprises carbon black.

25. The method according to claim 10, wherein the toner particles have a residual monomer content of at most 500 ppm by weight of the toner particles.

26. The method according to claim 10, wherein the toner particles have a residual monomer content of at most 200 ppm by weight of the toner particles.

27. The method according to claim 10, wherein the toner particles have a residual monomer content of at most 100 ppm by weight of the toner particles.

28. An image forming method comprising:

a charging step of charging an image-bearing member, an electrostatic image forming step of forming an electrostatic image on the charged image-bearing member;

a developing step of developing the electrostatic image with a toner carried on a developer-carrying member to form a toner image on the image-bearing member, a first transfer step of transferring the toner image on the image-bearing member to an intermediate transfer member, a second transfer step of transferring the toner image on the intermediate transfer member onto a recording material, and a fixing step of heat-fixing the toner image on the recording material; wherein the toner comprises toner particles each containing a binder resin, a colorant and a wax;

each toner particle has such a microtexture as to provide a cross-section exhibiting a matrix of the binder resin, and a particle of the wax enclosed within the matrix, and the colorant is dispersed to provide a projection area (B) in the binder resin and a projection area (W) in the wax giving a ratio B/W of 0/100–60/40, respectively, as observed through a transmission microscope (TEM); wherein the wax is present in amounts from 0.5 to 30 wt. % based on the weight of the toner, and wherein the wax particles are enclosed within the toner particles to provide an average of ratio r/R from 0.10–0.95, where R represents a longer axis diameter of a cross-section of the toner particle and r represents the largest longer axis diameter of a wax particle enclosed in each said toner particle.

29. The method according to claim 28, wherein the developer-carrying member is a developing sleeve and the developing sleeve has a surface roughness Ra of at most 1.5 μm and is moved at a circumferential speed which is 1.05–3 times that of the image-bearing member in the developing step.

30. The method according to claim 28, wherein a magnetic blade or metal blade is disposed opposite to and with a gap from the developer carrying member.

31. The method according to claim 28, wherein an elastic blade is abutted against the developer-carrying member.

32. The method according to claim 28, wherein the developing is performed while applying an alternating electric field between the developer-carrying member and the image-bearing member disposed with a spacing from each other.

33. The method according to claim 28, wherein the image-bearing member is charged by a charging member supplied with a voltage from an external voltage supply and contacting the image-bearing member.

34. The method according to claim 28, wherein in the second transfer step, the toner image on the intermediate transfer member is transferred onto the recording material by the action of a transfer member abutted against the intermediate transfer member via the recording material.

35. The method according to claim 28, wherein the heat-fixing of the toner image is performed by a heat-fixing apparatus free from supply of an offset-preventing liquid or a cleaner for the heat-fixing apparatus.

36. The method according to claim 28, wherein the heat-fixing of the toner image is performed by a heat-fixing apparatus including a fixedly supported heating member, and a pressing member for pressing the recording material carrying the toner image against the heating member via a film.

37. The method according to claim 28, performed by an image forming apparatus equipped with a re-use mechanism for recovering a transfer residual toner remaining on the image-bearing member, and re-using the recovered toner in the developing step.

38. The method according to claim 28, wherein the ratio B/W is 0/100 to 40/60.

39. The method according to claim 28, wherein the toner particles have a shape factor SF-1 of 100–160 and a shape factor SF-2 of 100–140.

40. The method according to claim 28, wherein the toner particles have a shape factor SF-1 of 100–140 and a shape factor SF-2 of 100–120.

41. The method according to claim 28, wherein the toner particles have a shape factor ratio (SF-2)/(SF-1) of at most 1.0.

42. The method according to claim 28, wherein the colorant comprises carbon black.

43. The method according to claim 28, wherein the toner particles have a residual monomer content of at most 500 ppm by weight of the toner particles.

44. The method according to claim 28, wherein the toner particles have a residual monomer content of at most 200 ppm by weight of the toner particles.

45. The method according to claim 28, wherein the toner particles have a residual monomer content of at most 100 ppm by weight of the toner particles.

* * * * *